US011276965B2

(12) United States Patent
Cheng

(10) Patent No.: US 11,276,965 B2
(45) Date of Patent: Mar. 15, 2022

(54) ELECTRICAL CONNECTOR

(71) Applicant: LOTES CO., LTD, Keelung (TW)

(72) Inventor: Wei Jin Cheng, Keelung (TW)

(73) Assignee: LOTES CO., LTD, Keelung (TW)

( * ) Notice: Subject to any disclaimer, the term of this patent is extended or adjusted under 35 U.S.C. 154(b) by 53 days.

(21) Appl. No.: 17/036,093

(22) Filed: Sep. 29, 2020

(65) Prior Publication Data

US 2021/0175664 A1 Jun. 10, 2021

(30) Foreign Application Priority Data

Dec. 10, 2019 (CN) ..... 201911258968.3

(51) Int. Cl.

| | |
|---|---|
| ***H01R 4/66*** | (2006.01) |
| ***H01R 13/6471*** | (2011.01) |
| ***H01R 12/72*** | (2011.01) |
| ***H01R 13/05*** | (2006.01) |
| ***H01R 13/502*** | (2006.01) |
| ***H01R 13/6585*** | (2011.01) |

(52) U.S. Cl.

CPC ..... *H01R 13/6471* (2013.01); *H01R 12/722* (2013.01); *H01R 13/05* (2013.01); *H01R 13/502* (2013.01); *H01R 13/6585* (2013.01)

(58) Field of Classification Search

CPC ..... H01R 13/6471; H01R 13/6585; H01R 13/502; H01R 13/05; H01R 12/722; H01R 12/725; H01R 12/727

USPC ..... 439/92–108

See application file for complete search history.

(56) References Cited

U.S. PATENT DOCUMENTS

| | | | | |
|---|---|---|---|---|
| 9,496,657 | B1 * | 11/2016 | Chang | H01R 13/6597 |
| 2018/0145462 | A1 * | 5/2018 | Feng | H01R 13/6596 |
| 2020/0169019 | A1 * | 5/2020 | Cheng | H01R 13/6582 |

FOREIGN PATENT DOCUMENTS

| | | |
|---|---|---|
| CN | 201430310 Y | 3/2010 |
| CN | 207925718 U | 9/2018 |
| CN | 110061391 A | 7/2019 |

* cited by examiner

*Primary Examiner* — Khiem M Nguyen

(74) *Attorney, Agent, or Firm* — Locke Lord LLP; Tim Tingkang Xia, Esq.

(57) ABSTRACT

An electrical connector includes an insulating body. Multiple terminals are provided on the insulating body, including two signal terminal pairs and two adjacent ground terminals located between the two signal terminal pairs. A metal shell is provided and covering outside the insulating body, and includes a neck portion extending backward from a top plate, and a first elastic arm, a second elastic arm and a third elastic arm formed by respectively extending backward from the neck portion. Each of the three elastic arms has a contact portion. The contact portions of two adjacent elastic arms are staggered to each other. A ground terminal is provided between two adjacent elastic arms. When the neck portion deviates toward different directions, each of the two ground terminals is in contact with the contact portion of at least one of the elastic arms.

27 Claims, 17 Drawing Sheets

A-A

B-B

C-C

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201911258968.3 filed in China on Dec. 10, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector improving the high frequency characteristics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector is used to mate with a mating component. The electrical connector includes an insulating body, a plurality of terminals accommodated in the insulating body, and a shielding shell shielding outside the insulating body. A top end of the insulating body is formed with a mating cavity concavely provided toward a bottom end thereof and used to accommodate the mating component. The terminals are divided into two rows arranged at two sides of the mating cavity. Each row of terminals includes a plurality of signal terminals and a plurality of ground terminals arranged in a left-right direction, and the ground terminals are located between two of the signal terminals. Each ground terminal is provided with a soldering portion, and a matching portion extending from the soldering portion toward the shielding shell. The shielding shell includes a plate body portion and a pair of clamping arms provided opposite to each other and respectively extending from a bottom portion of the plate body portion toward the matching portion. One of the clamping arms has a first contact portion provided rightward, and the other of the clamping arms has a second contact portion provided leftward. The first contact portion and the second contact portion are provided to align in the left-right direction. The matching portion is located between the first contact portion and the second contact portion. The first contact portion and the second contact portion clamp the matching portion, thus facilitating grounding through the ground terminal.

However, a width of each ground terminal in the left-right direction is small. Meanwhile, the first contact portion and the second contact portion are provided to align, such that a distance between the first contact portion and the second contact portion in the left-right direction is small. Thus, a thickness of a punch for punching a gap between the first contact portion and the second contact portion in the left-right direction may be less than a thickness of the metal plate for forming the first contact portion and the second contact portion, such that the punch may break when forming the first contact portion and the second contact portion. Further, when the shielding shell deviates rightward due to factors such as vibration of the outer environment, the first contact portion rightward abuts the matching portion of a corresponding ground terminal, which generates a larger normal force, and when the shielding shell deviates leftward due to factors such as vibration of the outer environment, the second contact portion leftward abuts the matching portion of the corresponding ground terminal, which generates a larger normal force, thus resulting in the normal force applied to the matching portion of the ground terminal to have a large change before and after the shielding shell deviates. Further, the excessive normal force may cause the first contact portion and the second contact portion to easily fatigue, such that when the shielding shell is located at a normal usage position without deviation, the first contact portion and the second contact portion are not guaranteed to be stably in contact with the corresponding ground terminal, thereby resulting in the shielding shell not facilitating stable grounding through the ground terminals, affecting the high frequency characteristics of the electrical connector, and not satisfying higher usage requirements.

Therefore, a heretofore unaddressed need to design a novel electrical connector exists in the art to address the aforementioned deficiencies and inadequacies.

SUMMARY

In view of the deficiency of the background, the present invention is directed to an electrical connector, which ensures a contact point to always exist between the metal shell and the ground terminal.

To achieve the foregoing objective, the present invention adopts the following technical solutions.

An electrical connector is configured to mate with a mating member. The electrical connector includes: an insulating body, provided with a front end surface, wherein a mating slot is formed by being backward concavely provided on the front end surface to be inserted by the mating member; a plurality of terminals, provided on the insulating body, wherein the terminals comprise two signal terminal pairs and two adjacent ground terminals located between the two signal terminal pairs, and each of the two signal terminal pairs comprises two signal terminals configured to transmit differential signals; and a metal shell, provided and covering outside the insulating body, wherein the metal shell comprises a top plate located above the insulating body, a neck portion formed by extending backward from the top plate, and a first elastic arm, a second elastic arm and a third elastic arm formed by respectively extending backward from the neck portion, the second elastic arm is located between the first elastic arm and the third elastic arm, each of the first elastic arm and the second elastic arm has a first contact portion provided rightward, each of the second elastic arm and the third elastic arm has a second contact portion provided leftward, the first contact portion of the first elastic arm and the second contact portion of the second elastic arm are provided to be staggered in a front-rear direction, the first contact portion of the second elastic arm and the second contact portion of the third elastic arm are provided to be staggered in the front-rear direction, one of the two adjacent ground terminals is located between the first contact portion of the first elastic arm and the second contact portion of the second elastic arm, and the other of the two adjacent ground terminals is located between the first contact portion of the second elastic arm and the second contact portion of the third elastic arm; wherein when the neck portion deviates rightward, the first contact portion of the first elastic arm rightward abuts the one of the two adjacent ground terminals, and the first contact portion of the second elastic arm rightward abuts the other of the two adjacent ground terminals; and when the neck portion deviates leftward, the second contact portion of the second elastic arm leftward abuts the one of the two adjacent ground terminals, and the second contact portion of the third elastic arm leftward abuts the other of the two adjacent ground terminals.

In certain embodiments, each of the ground terminals is provided with a base portion accommodated in the insulating body, and the base portion protrudes upward out of an upper surface of the insulating body and is higher than the first contact portion and the second contact portion.

In certain embodiments, a first contact arm and a second contact arm extend forward from the base portion, the first contact arm has a first conductive portion located at an upper side of the mating slot, the second contact arm has a second conductive portion located at a lower side of the mating slot, the first conductive portion and the second conductive portion are configured to mate with the mating member, a soldering portion extends backward from the base portion to be soldered with a circuit board, and a bottom surface of the soldering portion is higher than a lowest point of the second contact arm.

In certain embodiments, the first conductive portion and the second conductive portion are provided to be staggered in the front-rear direction.

In certain embodiments, the base portion of each of the two ground terminals has a guidance portion formed by extending forward and exposed upward out of the insulating body, the guidance portion of the one of the two ground terminals is configured to guide the base portion of the one of the two ground terminals forward to be inserted between the first elastic arm and the second elastic arm and is located in front of the first contact portion of the first elastic arm and the second contact portion of the second elastic arm, and the guidance portion of the other of the two ground terminals is configured to guide the base portion of the other of the two ground terminals forward to be inserted between the second elastic arm and the third elastic arm and is located in front of the first contact portion of the second elastic arm and the second contact portion of the third elastic arm.

In certain embodiments, a top end of each of the two ground terminals passes upward beyond the two signal terminal pairs, and a bottom end of each of the two ground terminals passes downward beyond the two signal terminal pairs.

In certain embodiments, the metal shell further comprises at least one elastic portion connected to the top plate, the at least one elastic portion and the neck portion are provided to be staggered in the front-rear direction, the mating member is provided with an upper shielding member, and the at least one elastic portion protrudes into the mating slot to downward abut the upper shielding member.

In certain embodiments, one of the two signal terminal pairs is located at a left side of the first elastic arm, and the other of the two signal terminal pairs is located at a right side of the third elastic arm.

In certain embodiments, the neck portion and the second elastic arm are provided to align in the front-rear direction.

In certain embodiments, the first elastic arm and the third elastic arm are symmetrical in a left-right direction relative to the neck portion.

In certain embodiments, the second elastic arm is provided with an extending portion connected to the neck portion, a width of the extending portion in a left-right direction is less than a distance between the first contact portion of the second elastic arm and the second contact portion of the second elastic arm.

In certain embodiments, the second elastic arm is provided with a guiding portion to guide the second elastic arm to be inserted backward between the two adjacent ground terminals, the guiding portion is located behind the first contact portion and the second contact portion of the second elastic arm, and a width of the guiding portion in a left-right direction is less than a distance between the two adjacent ground terminals.

In certain embodiments, the first contact portion of the first elastic arm and the second contact portion of the third elastic arm align in a left-right direction, and the first contact portion of the second elastic arm and the second contact portion of the second elastic arm align in the left-right direction.

In certain embodiments, the electrical connector further includes a pushing member and at least one retaining member, wherein the at least one retaining member is retained to the insulating body, the retaining member is provided with an arm portion, the arm portion has an abutting portion and a buckling portion, when the pushing member moves backward relative to the insulating body and abuts the abutting portion, the buckling portion is pushed to buckle with the mating member, preventing the mating member from moving forward and detaching from being in contact with the terminals, and when the pushing member moves forward relative to the insulating body and is detached from the abutting portion, the buckling portion is released from buckling with the mating member.

In certain embodiments, two retaining members are respectively provided at a left side and a right side of the insulating body, the pushing member is provided with a connecting portion and two pushing portions formed by respectively extending backward from a left side and a right side of the connecting portion, when the pushing member moves backward, the two pushing portions one-to-one correspondingly abut the two abutting portions of the two retaining members, and the two buckling portions of the two retaining members are pushed to buckle with the mating member, and when the pushing member moves forward, the two pushing portions move forward to correspondingly detach from the two abutting portions of the two retaining members, and the two buckling portions of the two retaining members are released from buckling with the mating member.

In certain embodiments, each of the two retaining members comprises a retaining portion connected to the arm portion, the retaining portion is retained to the insulating body, the arm portion is formed by extending forward from the retaining portion, the buckling portion is formed by protruding upward, two buckling slots are respectively provided at a left side and a right side of the mating member, when the pushing member moves backward, the two pushing portions move to be below the two abutting portions of the two retaining members, and the two buckling portions of the two retaining members are pushed to protrude upward into the two buckling slots correspondingly, and when the pushing member moves forward, the two buckling portions of the two retaining members retreat downward from the two buckling slots correspondingly.

In certain embodiments, each of the two pushing portions is provided with a first position limiting portion, the metal shell is provided with two first stopping portions located at a bottom portion of the insulating body corresponding to the first position limiting portions of the two pushing portions respectively, when the buckling portions of the two retaining members are released from buckling with the mating member, each of the two first stopping portions is located in front of a corresponding one of the first position limiting portions of the two pushing portions to stop the first position limiting portions of the two pushing portions and to prevent the two pushing portions from detaching from the insulating body.

Compared with the related art, the electrical connector according to certain embodiments of the present invention has the following beneficial effects.

The neck portion extends backward from the top plate of the metal shell, and the neck portion extends backward respectively to form the first elastic arm, the second elastic arm and the third elastic arm. One of the ground terminals is located between the first contact portion of the first elastic arm and the second contact portion of the second elastic arm, and the other of the ground terminals is located between the first contact portion of the second elastic arm and the second contact portion of the third elastic arm. When the neck portion deviates rightward, the first contact portion of the first elastic arm rightward abuts one of the ground terminals, and the first contact portion of the second elastic arm rightward abuts the other of the ground terminals. When the neck portion deviates leftward, the second contact portion of the second elastic arm leftward abuts the one of the ground terminals, and the second contact portion of the third elastic arm leftward abuts the other of the ground terminals. The first contact portion and the second contact portion used to be in contact with the same ground terminal are provided to be staggered in the front-rear direction. The first contact portion and the second contact portion are provided to be staggered in the front-rear direction, facilitating increasing a distance between the first contact portion of the first elastic arm and the second elastic arm, increasing a distance between the first contact portion of the second elastic arm and the third elastic arm and a distance between the second contact portion of the second elastic arm and the first elastic arm, and increasing a distance between the second contact portion of the third elastic arm and the second elastic arm, such that a thickness of the punch in the left-right direction is greater than the width of the metal plate forming the first contact portions and the second contact portions, the punch does not easily break, and the usage life of the punch is increased. When the metal shell deviates rightward or leftward, due to the existence of the neck portion, which may elastic deform in the left-right direction, thus further providing a swinging force in the left-right direction, facilitating reducing the degree of the elastic leftward or rightward deviations of the first elastic arm, the second elastic arm and the third elastic arm, such that the normal force applied to the two ground terminals by the first contact portions and the second contact portions before and after the metal shell deviates does not significantly change, thereby increasing the usage lives of the first elastic arm, the second elastic arm and the third elastic arm, and ensuring the metal shell to have a contact point with each ground terminal, thereby achieving the stable electrical connection therebetween, such that the electrical connector achieves the high frequency characteristics and satisfies higher usage requirements.

An electrical connector is configured to mate with a mating member. The electrical connector includes: an insulating body, provided with a front end surface, wherein a mating slot is formed by being backward concavely provided on the front end surface to be inserted by the mating member; a plurality of terminals, provided on the insulating body, wherein the terminals comprise two signal terminals and at least one ground terminal located between the two signal terminals; and a metal shell, provided and covering outside the insulating body, wherein the metal shell comprises a top plate located above the insulating body, a neck portion formed by extending backward from the top plate, and a first elastic arm and a second elastic arm formed by respectively extending backward from the neck portion, the first elastic arm has a first contact portion provided rightward, the second elastic arm has a second contact portion provided leftward, the first contact portion and the second contact portion are provided to be staggered in a front-rear direction, and one of the at least one ground terminal is located between the first contact portion and the second contact portion; wherein when the neck portion deviates rightward, the first contact portion rightward abuts the one of the at least one ground terminal, and when the neck portion deviates leftward, the second contact portion leftward abuts the one of the at least one ground terminal.

In certain embodiments, the ground terminal is provided with a base portion accommodated in the insulating body, and the base portion protrudes upward out of an upper surface of the insulating body and is higher than the first contact portion and the second contact portion.

In certain embodiments, a first contact arm and a second contact arm extend forward from the base portion, the first contact arm has a first conductive portion located at an upper side of the mating slot, the second contact arm has a second conductive portion located at a lower side of the mating slot, the first conductive portion and the second conductive portion are configured to mate with the mating member, a soldering portion extends backward from the base portion to be soldered with a circuit board, and a bottom surface of the soldering portion is higher than a lowest point of the second contact arm.

In certain embodiments, the base portion has a guidance portion formed by extending forward, the guidance portion of the one of the at least one ground terminal is configured to guide the base portion of the one of the at least one ground terminal forward to be inserted between the first elastic arm and the second elastic arm.

In certain embodiments, a top end of the at least one ground terminal passes upward beyond the two signal terminals, and a bottom end of the at least one ground terminal passes downward beyond the two signal terminals.

In certain embodiments, the terminals comprise two ground terminals located between the two signal terminals, the metal shell further comprises a third elastic arm formed by extending backward from the neck portion, the second elastic arm is located between the first elastic arm and the third elastic arm, each of the first elastic arm and the second elastic arm has a first contact portion provided rightward, each of the second elastic arm and the third elastic arm has a second contact portion provided leftward, the first contact portion of the second elastic arm and the second contact portion of the third elastic arm are provided to be staggered in the front-rear direction, one of the two ground terminals is located between the first contact portion of the first elastic arm and the second contact portion of the second elastic arm, and the other of the two ground terminals is located between the first contact portion of the second elastic arm and the second contact portion of the third elastic arm.

In certain embodiments, the neck portion and the second elastic arm are provided to align in the front-rear direction.

In certain embodiments, the second elastic arm is provided with an extending portion connected to the neck portion, a width of the extending portion in a left-right direction is less than a distance between the first contact portion of the second elastic arm and the second contact portion of the second elastic arm.

In certain embodiments, the electrical connector further includes a pushing member and two retaining members, wherein the two retaining members are respectively retained to a left side and a right side of the insulating body, each of the two retaining members is provided with an arm portion extending forward, the arm portion has an abutting portion and a buckling portion connected to the abutting portion, the buckling portion is located in front of the abutting portion, two pushing portions are respectively provided at a left side and a right side of the pushing member and extend backward, the pushing member is provided with a guiding chamfer at a rear portion of each of the pushing portions and extending backward and downward, when the pushing member moves backward relative to the insulating body, the guiding chamfer guides each of the two pushing portions to be located below the buckling portion of a corresponding one of the two retaining members and to push the abutting portion of the corresponding one of the two retaining members upward, and the two buckling portions of the two retaining members are pushed to protrude into the mating slot and to buckle with the mating member, and when the pushing member moves forward relative to the insulating body, the two pushing portions move forward to correspondingly detach from the two abutting portions of the two retaining members, and the two buckling portions of the two retaining members move downward to be released from buckling with the mating member.

In certain embodiments, each of the two pushing portions is provided with a first position limiting portion and a second position limiting portion, the first position limiting portion and the second position limiting portion are provided at an interval in the front-rear direction and staggered in a vertical direction, a left side and a right side of the metal shell are respectively provided with two first stopping portions and two second stopping portions located at a bottom portion of the insulating body, the first stopping portions and the second stopping portions are provided at an interval in the front-rear direction and staggered in the vertical direction, when the buckling portions of the two retaining members are buckled to the mating member, each of the first stopping portions is located in front of the first position limiting portions of a corresponding one of the two pushing portions with an interval therebetween, and each of the second stopping portions is located in front of the second position limiting portions of a corresponding one of the two pushing portions to limit the pushing member from moving forward, and when the buckling portions of the two retaining members are released from buckling with the mating member, the first stopping portions stop the first position limiting portions of the two pushing portions to limit the pushing member from excessively moving forward, and the second stopping portions are located behind the second position limiting portions of the two pushing portions to limit the pushing member from moving backward.

Compared with the related art, the electrical connector according to certain embodiments of the present invention has the following beneficial effects.

The neck portion extends backward from the top plate of the metal shell, and the neck portion extends backward respectively to form the first elastic arm and the second elastic arm. The ground terminal is located between the first contact portion and the second contact portion. When the neck portion deviates rightward, the first contact portion rightward abuts the ground terminal, and when the neck portion deviates leftward, the second contact portion leftward abuts the ground terminal. The first contact portion and the second contact portion are provided to be staggered in the front-rear direction. The first contact portion and the second contact portion are provided to be staggered in the front-rear direction, facilitating increasing a distance between the first contact portion of the first elastic arm and the second elastic arm, such that a thickness of the punch in the left-right direction is greater than the width of the metal plate forming the first contact portion and the second contact portion, the punch does not easily break, and the usage life of the punch is increased. When the metal shell deviates rightward or leftward, due to the existence of the neck portion, which may elastic deform in the left-right direction, thus further providing a swinging force in the left-right direction, facilitating reducing the degree of the elastic leftward or rightward deviations of the first elastic arm and the second elastic arm, such that the normal force applied to the ground terminal by the first contact portion and the second contact portion before and after the metal shell deviates does not significantly change, thereby increasing the usage lives of the first elastic arm and the second elastic arm, and ensuring the metal shell to have a contact point with each ground terminal, thereby achieving the stable electrical connection therebetween, such that the electrical connector achieves the high frequency characteristics and satisfies higher usage requirements.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
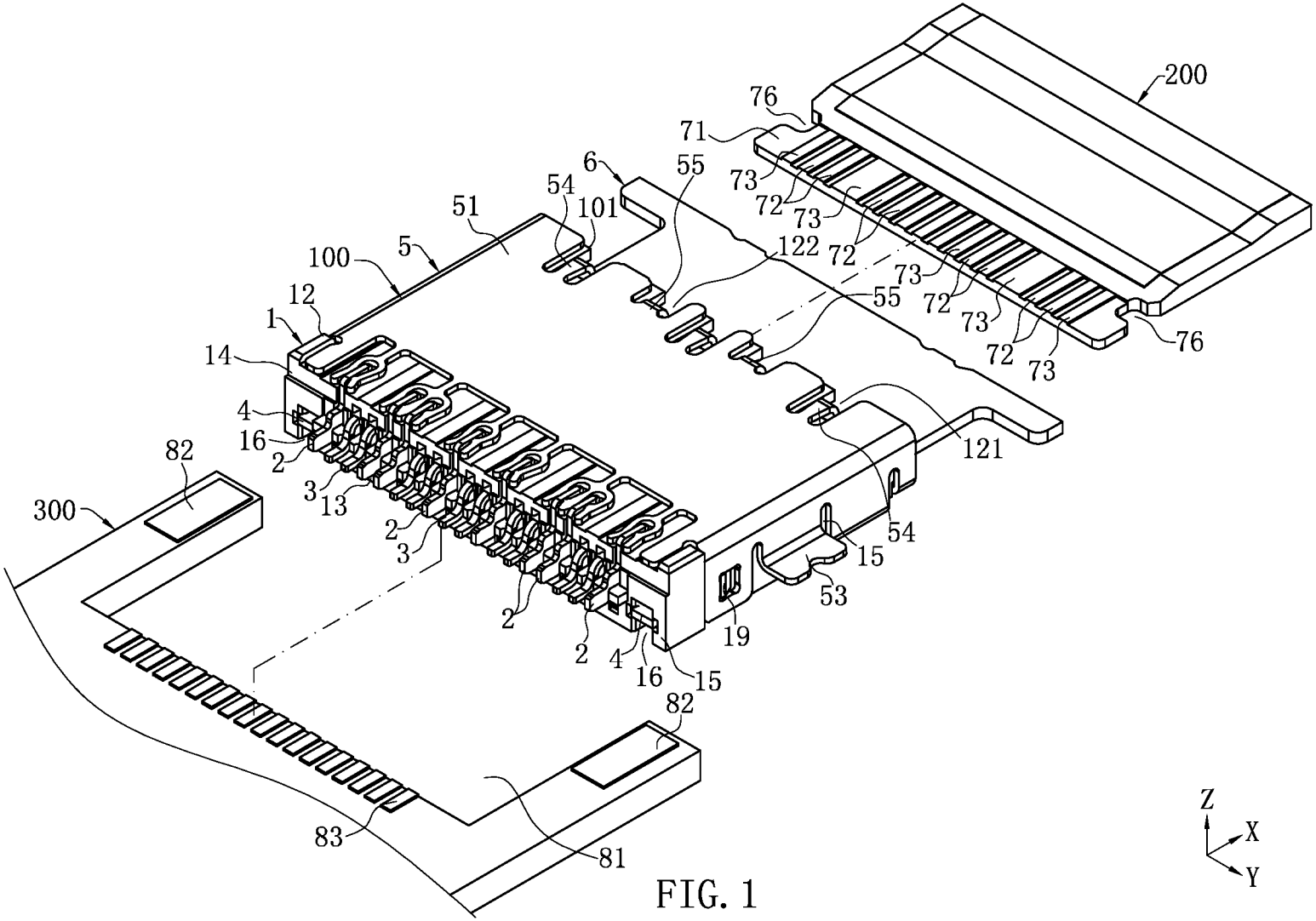
FIG. 1 is a perspective view of an electrical connector, a mating member and a circuit board according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-17. In accordance with the purposes of this invention, as embodied and broadly described herein, this invention, in one aspect, relates to an electrical connector.

Figure 4:
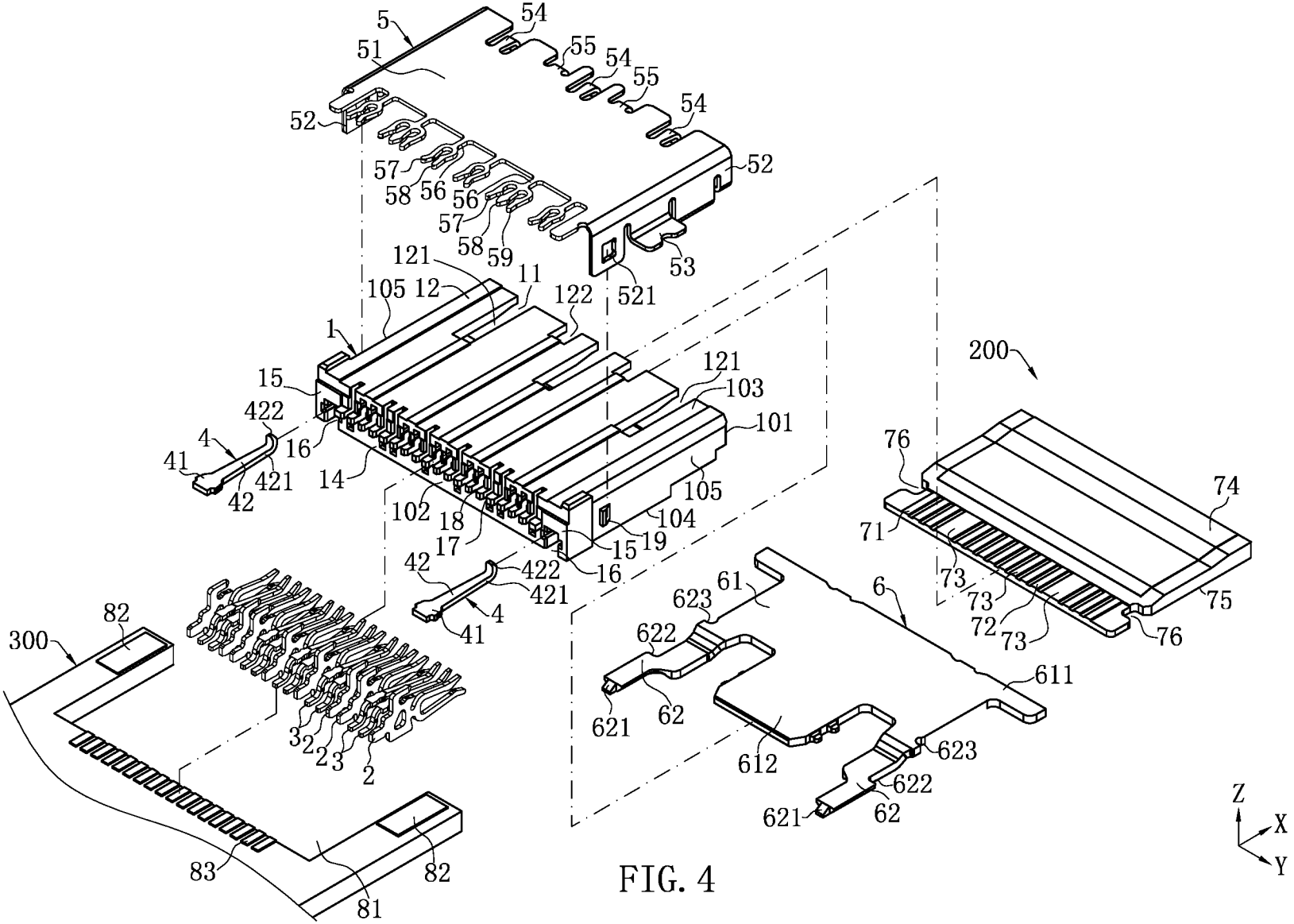
FIG. 4 is a perspective exploded view of the electrical connector in FIG. 1.
Figure 6:
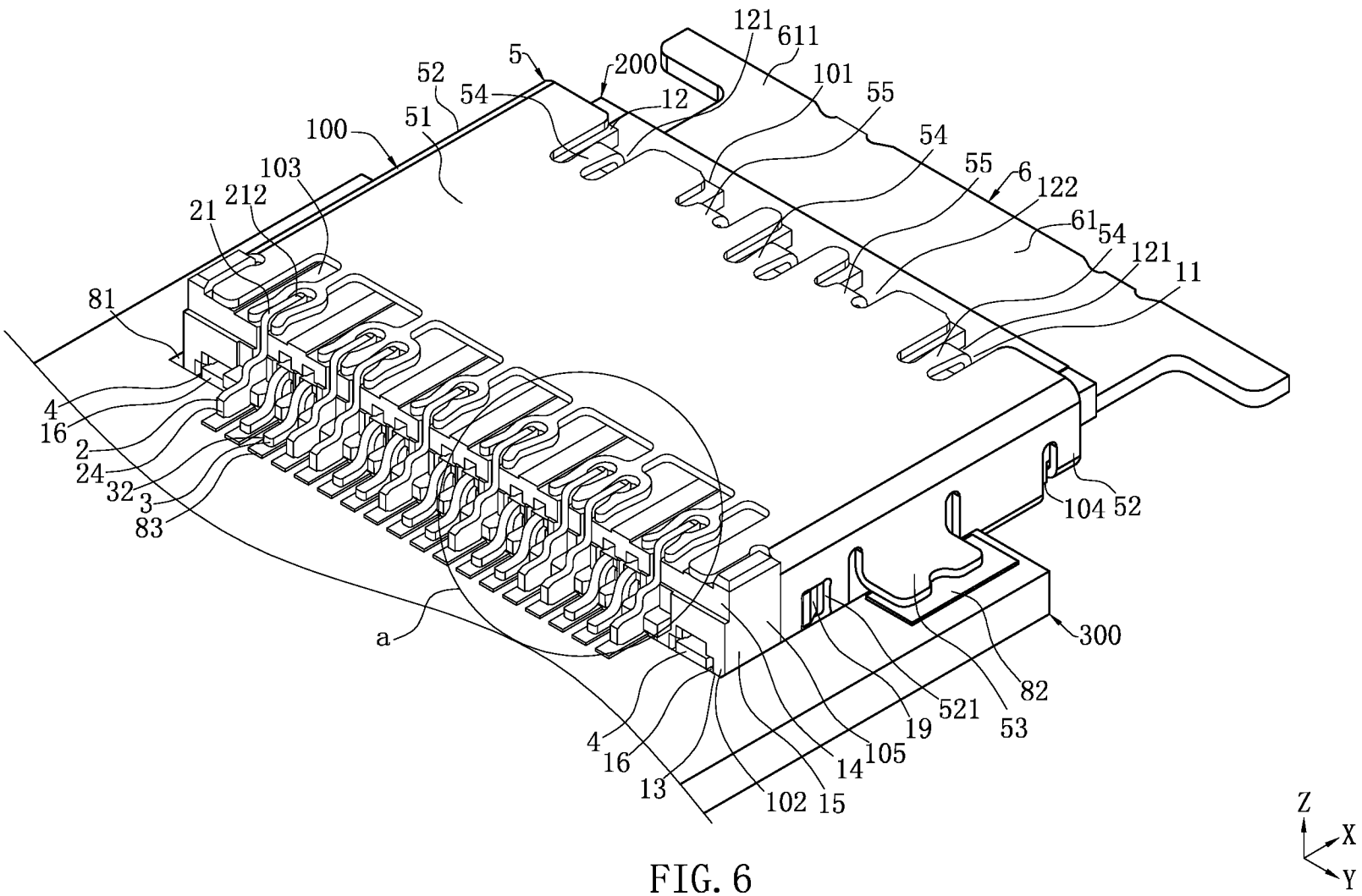
FIG. 6 is a perspective assembled view of FIG. 1.

As shown in FIG. 1, FIG. 4 and FIG. 6, an electrical connector 100 according to certain embodiments of the present invention is defined with a vertical direction Z, and a front-rear direction X and a left-right direction Y perpendicular to the vertical direction Z and perpendicular to each other.

Figure 10:
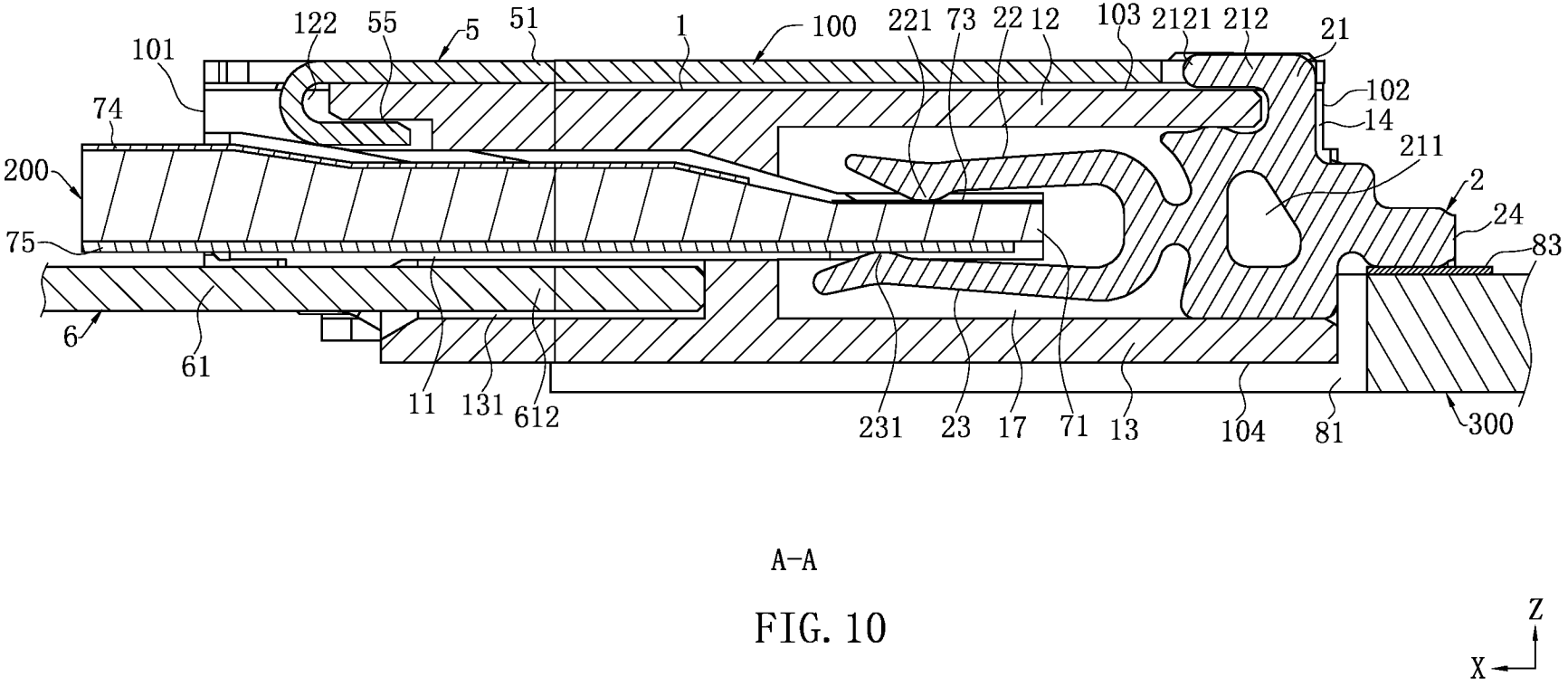
FIG. 10 is a sectional view of FIG. 8 sectioned along a line A-A.

As shown in FIG. 1, FIG. 6 and FIG. 10, the electrical connector 100 according to certain embodiments of the present invention is used to mate with a mating member 200. The electrical connector 100 is downward mounted on a circuit board 300. The mating member 200 is inserted backward into the electrical connector 100, forming an electrical connection therebetween.

As shown in FIG. 1, FIG. 4 and FIG. 6, the electrical connector 100 has an insulating body 1, a plurality of terminals provided on the insulating body 1, two retaining members 4 retained to the insulating body 1, a metal shell 5 provided and covering outside the insulating body 1, and a pushing member 6 accommodated in the insulating body 1. In other embodiments, only one retaining member 4 is provided.

Figure 2:
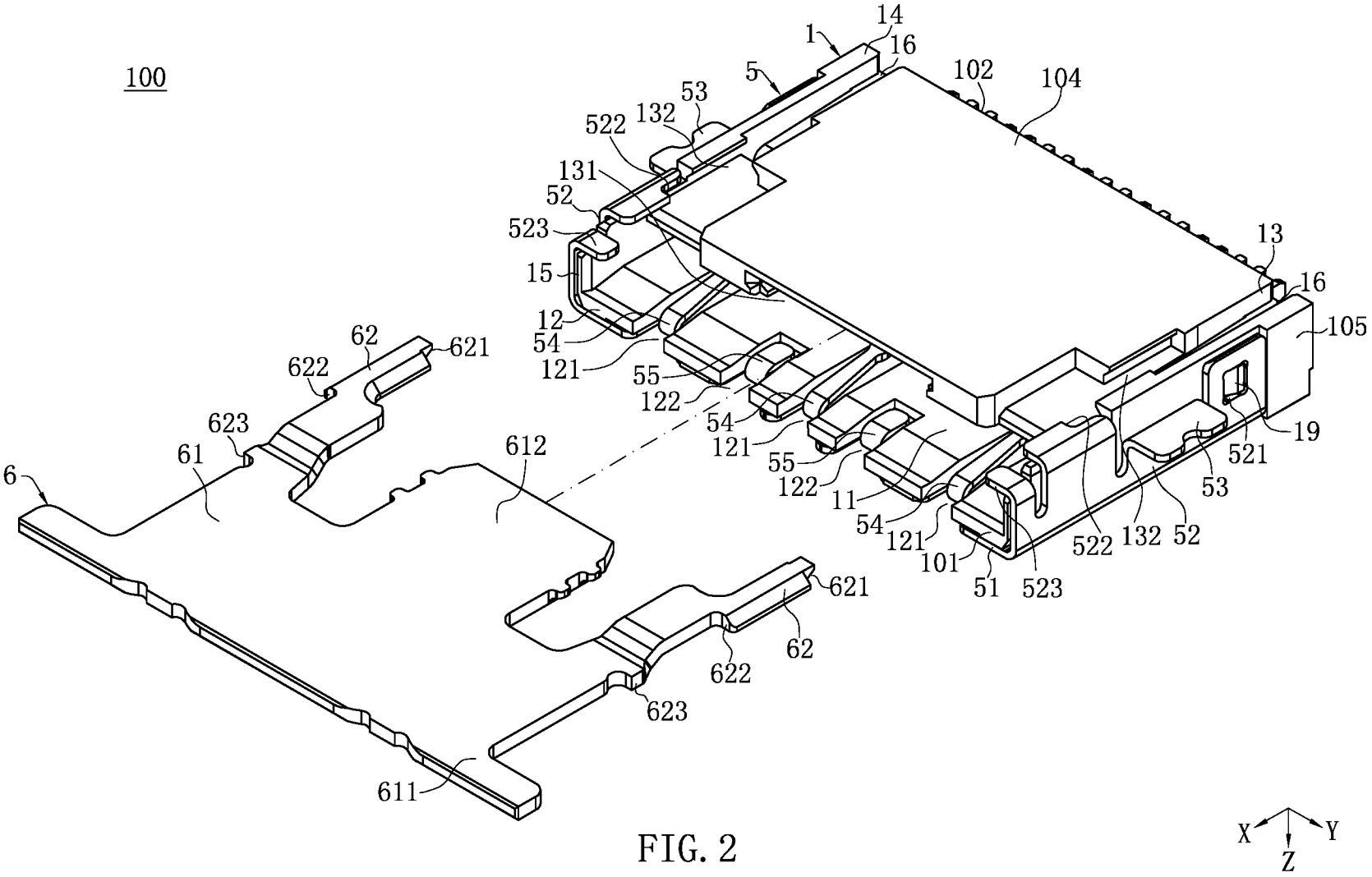
FIG. 2 is a perspective view of the electrical connector in FIG. 1 being 180° inversed prior to the pushing member being assembled to the insulating body.

As shown in FIG. 2, FIG. 4 and FIG. 10, the insulating body 1 has a front end surface 101 and a back end surface 102 provided opposite to each other in the front-rear direction, and a top surface 103 and a bottom surface 104 provided opposite to each other in the vertical direction, and two side surfaces 105 provided opposite to each other at the left side and the right side thereof. Each side surface 105 connects the front end surface 101 and the back end surface 102 in the front-rear direction, and connects the top surface 103 and the bottom surface 104 in the vertical direction. A mating slot 11 is formed by being backward concavely provided on the front end surface 101 to accommodate the mating member 200. The insulating body 1 has a top wall 12 located above the mating slot 11, a bottom wall 13 located below the mating slot 11, and a back wall 14 connecting the top wall 12 and the bottom wall 13. The electrical connector 100 further includes two side walls 15 located at a left side and a right side of the mating slot 11, and each side wall 15 connects the top wall 12 and the bottom wall 13 in the vertical direction.

Figure 11:
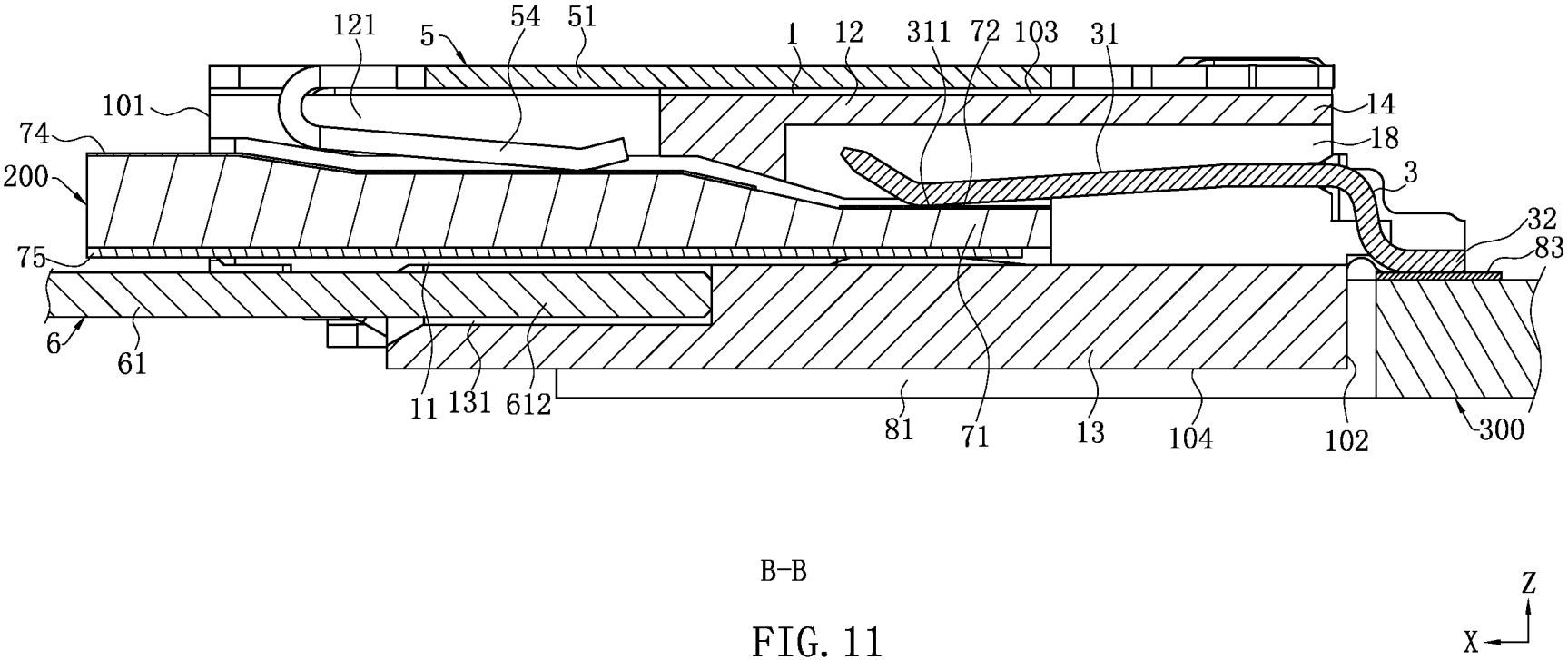
FIG. 11 is a sectional view of FIG. 8 sectioned along a line B-B.

As shown in FIG. 4, FIG. 10 and FIG. 11, the top wall 12 has a plurality of first grooves 121 and a plurality of second grooves 122 formed by being backward concavely provided on the front end surface 101. Each second groove 122 is located between two first grooves 121 in the left-right direction. A length of each first groove 121 in the front-rear direction is longer than a length of each second groove 122 in the front-rear direction. The first grooves 121 run upward through the top wall 12 in the vertical direction, and are in downward communication with the mating slot 11. A front portion of each second groove 122 close to the front end surface 101 runs vertically through the top wall 12 and is in downward communication with the mating slot 11. A rear portion of each second groove 122 close to the back end surface 102 only runs downward through the top wall 12 and is in downward communication with the mating slot 11. That is, the rear portion of each second groove 122 close to the back end surface 102 does not run upward through the top wall 12.

Figure 12:
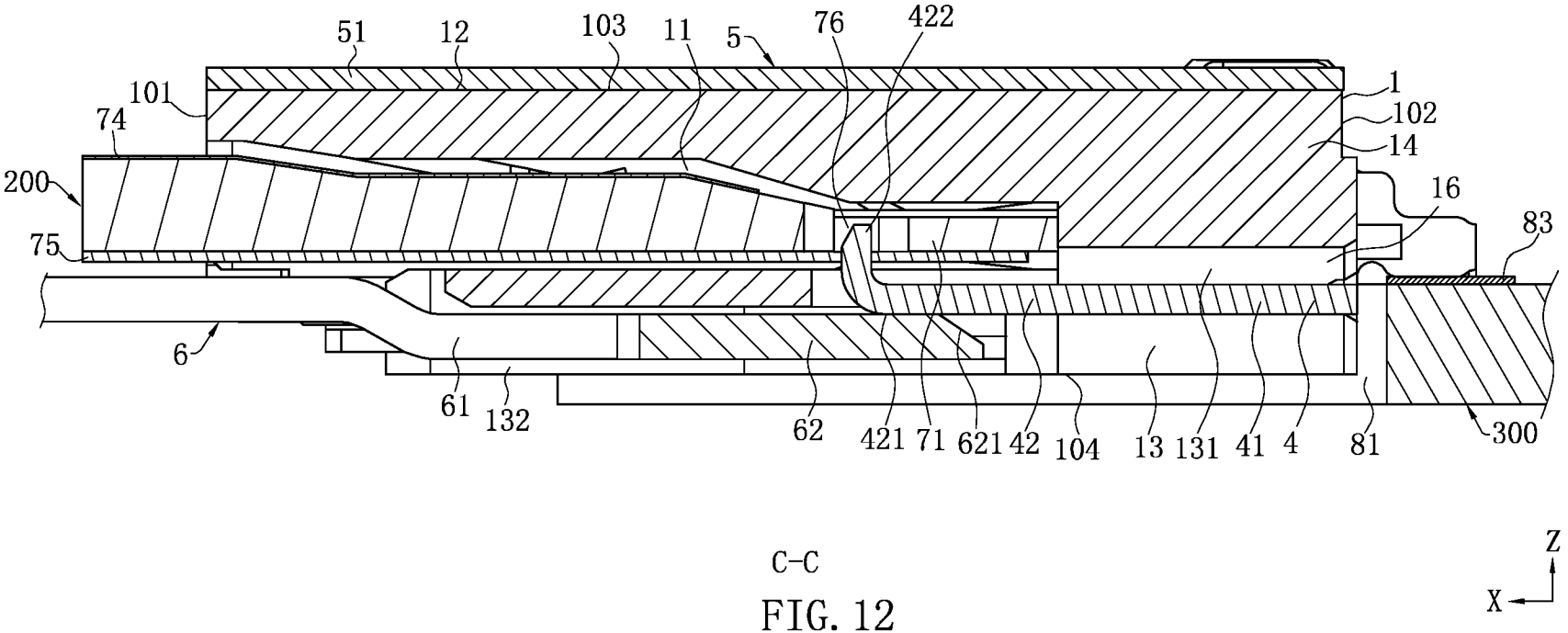
FIG. 12 is a sectional view of FIG. 8 sectioned along a line C-C.

As shown in FIG. 2, FIG. 10 and FIG. 12, the bottom wall 13 is formed with an accommodating slot 131 backward concavely provided on the front end surface 101 and two sliding slots 132 located at a left side and a right side of the accommodating slot 131. The accommodating slot 131 only runs upward through the bottom wall 13 and is in upward communication with the mating slot 11. That is, the accommodating slot 131 does not run downward through the bottom wall 13. A height of the accommodating slot 131 in the vertical direction is less than a height of the mating slot 11 in the vertical direction. A width of the accommodating slot 131 in the left-right direction is less than a width of the mating slot 11 in the left-right direction, and the accommodating slot 131 is substantially located at a central location of the mating slot 11 in the left-right direction. A length of the mating slot 11 in the front-rear direction is longer than a length of the accommodating slot 131 in the front-rear direction. The sliding slots 132 run downward through the bottom surface 104, and a rear end of each sliding slot 132 is in upward communication with the mating slot 11. The sliding slots 132 and the accommodating slot 131 are provided at intervals in the left-right direction. That is, the sliding slots 132 and the accommodating slot 131 are not in communication.

As shown in FIG. 2, FIG. 4 and FIG. 12, the insulating body 1 further has two mounting slots 16 formed by being forward concavely provided on the back end surface 102. The mounting slots 16 run downward through the bottom surface 104, and a front end of each mounting slot 16 is in upward communication with the mating slot 11. The two mounting slots 16 are located at the left side and the right side of the accommodating slot 131, and are not in communication with the accommodating slot 131. The two mounting slots 16 are provided to one-to-one align with the two sliding slots 132 in the front-rear direction, and each mounting slot 16 is in communication with the corresponding sliding slot 132 in the front-rear direction.

As shown in FIG. 4, FIG. 10 and FIG. 11, a plurality of grounding accommodating holes 17 and a plurality of signal accommodating holes 18 are formed by being forward concavely provided on the back end surface 102. At least one of the grounding accommodating holes 17 is provided between two pairs of the signal accommodating holes 18. In this embodiment, ten signal accommodating holes 18 are provided, eight grounding accommodating holes 17 are provided, and two grounding accommodating holes 17 or only one grounding accommodating hole 17 may be provided between two pairs of the signal accommodating holes 18. The signal accommodating holes 18 run forward through the rear wall 14 and extend forward to the top wall 12, and the signal accommodating holes 18 only run downward through the top wall 12 to be in communication with the mating slot 11. The grounding accommodating holes 17 run forward through the rear wall 14 and extend forward to the top wall 12 and the bottom wall 13. The grounding accommodating holes 17 only run upward through the bottom wall 13 and only run downward through the top wall 12, and are in communication with the mating slot 11 in the vertical direction. A top end of each grounding accommodating hole 17 passes upward beyond a top end of each signal accommodating hole 18, a rear end of each grounding accommodating hole 17 runs upward through the top surface 103, and a bottom end of each grounding accommodating hole 17 passes downward beyond a bottom end of each signal accommodating hole 18.

Figure 3:
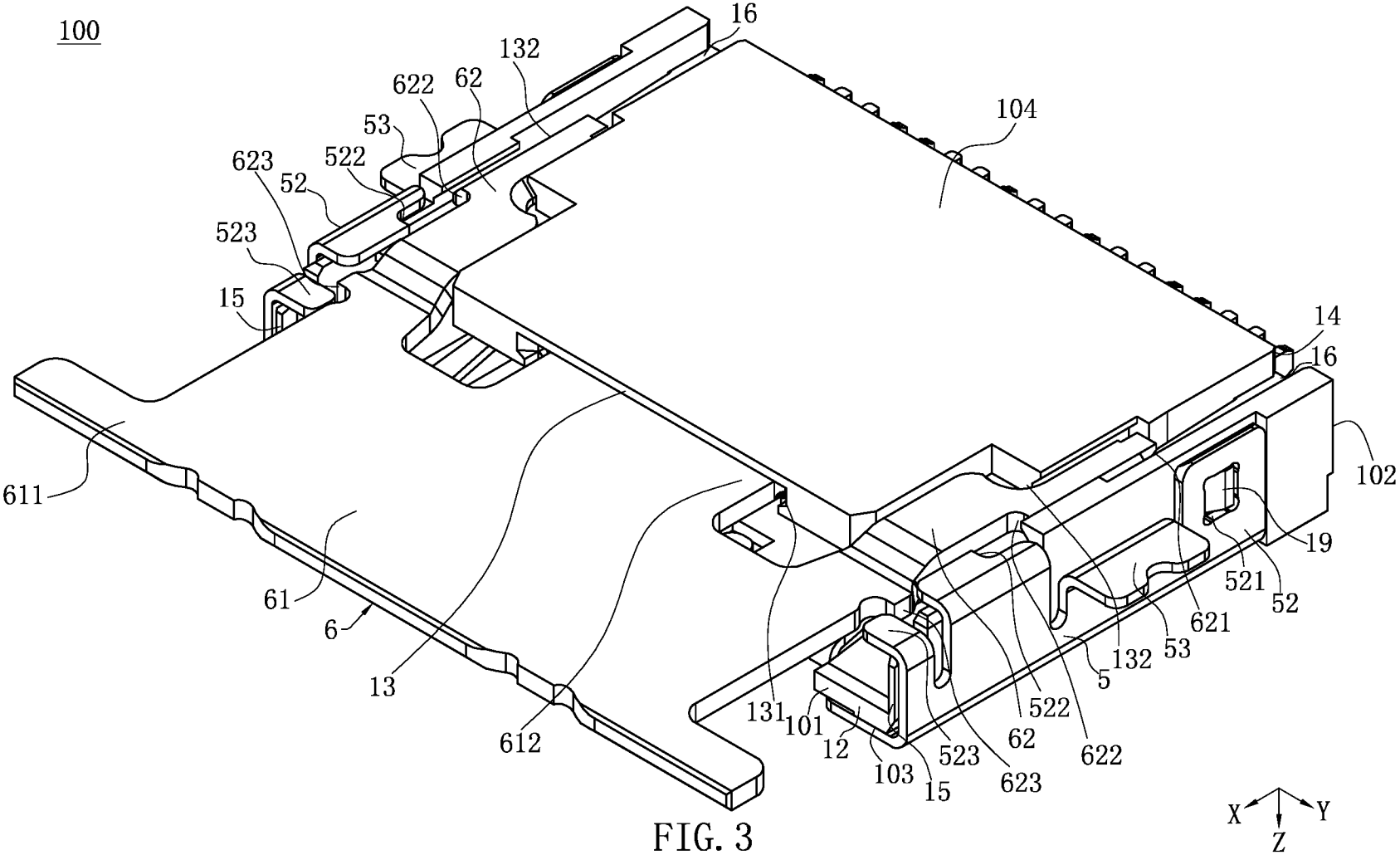
FIG. 3 is a perspective view of FIG. 2 after the pushing member is assembled to the insulating body.

As shown in FIG. 1, FIG. 3 and FIG. 4, each side surface 105 protrudes outward to form a protruding block 19. The protruding block 19 is provided close to the back end surface 102 and away from the front end surface 101.

Figure 8:
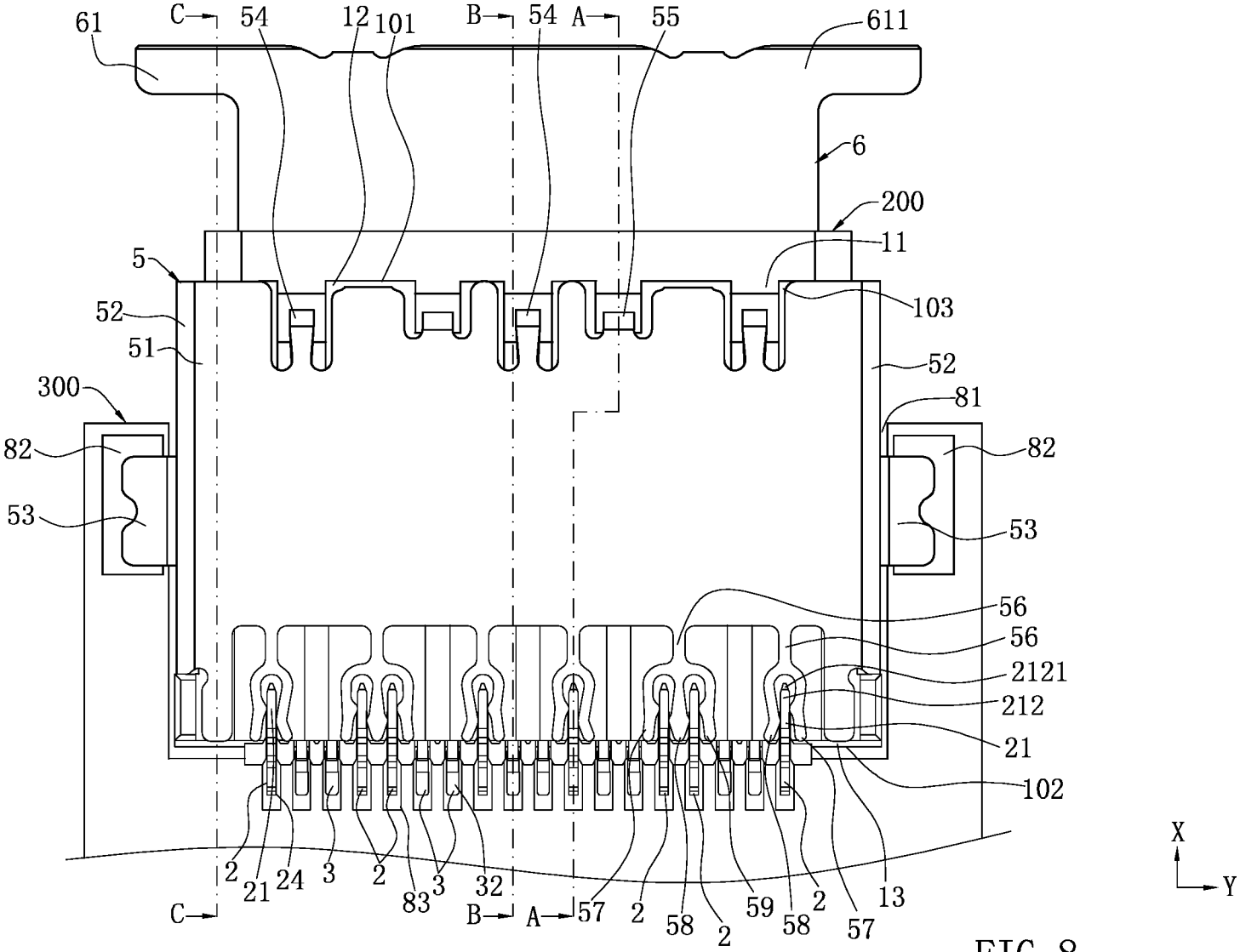
FIG. 8 is a top view of FIG. 6.
Figure 9:
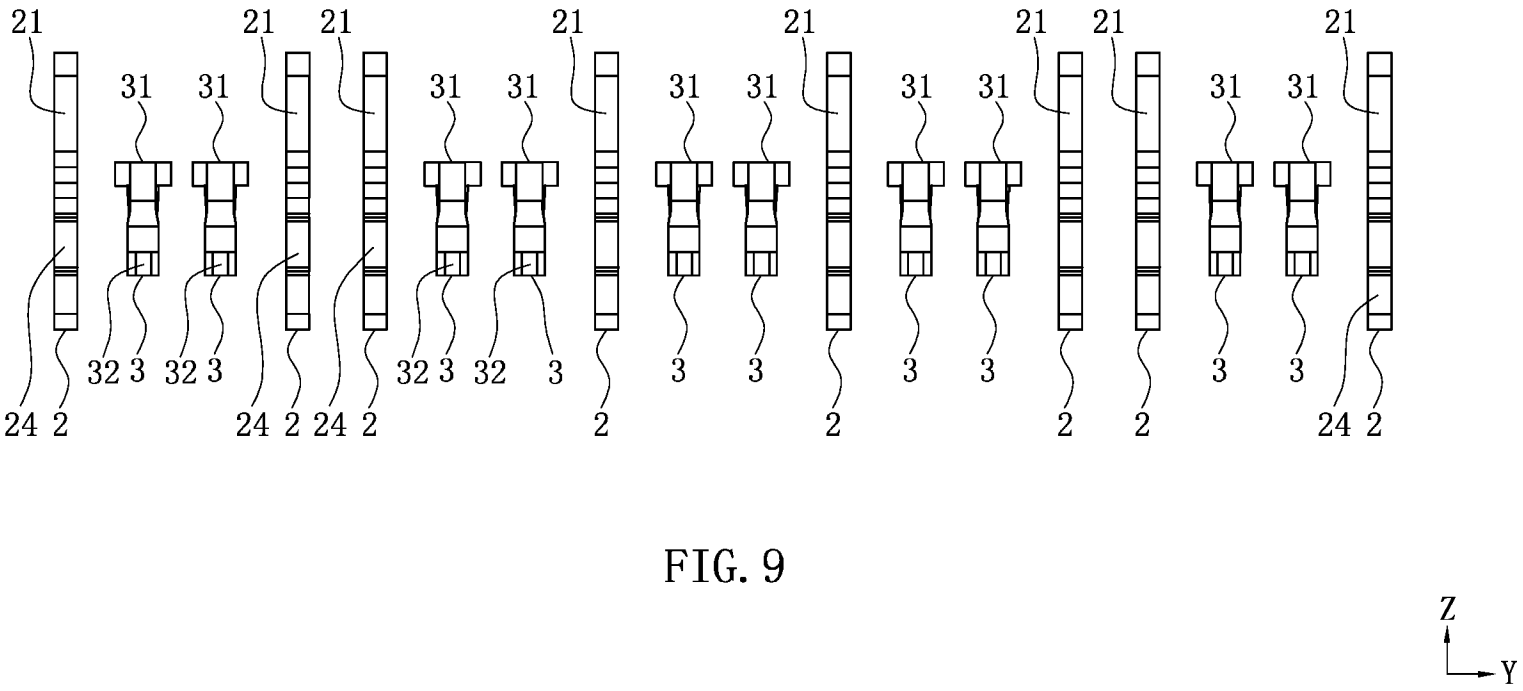
FIG. 9 is a back view of the terminal in FIG. 4.

As shown in FIG. 4, FIG. 8 and FIG. 9, the terminals include a plurality of ground terminals 2 and a plurality of signal terminal pairs. Each signal terminal pair includes two signal terminals 3 provided adjacent to each other for transmitting differential signals. Thus, each signal terminal pair is a differential signal terminal pair. Two adjacent ground terminals 2 or only one ground terminal 2 may be provided between two adjacent signal terminal pairs. In this embodiment, five signal terminal pairs are provided, and eight ground terminals 2 are provided. Two of the ground terminals are located at the two outermost sides of the terminals in the left-right direction.

As shown in FIG. 4, FIG. 9 and FIG. 10, the ground terminals 2 are formed by directly blanking a metal plate. That is, the ground terminals 2 are blanking-type terminals. The ground terminals 2 are inserted into the grounding accommodating holes 17 forward from back thereof. Each ground terminal 2 is provided with a base portion 21, which is flat plate shaped. The base portion 21 is retained in the corresponding ground accommodating hole 17. A top end of the base portion 21 passes upward beyond the signal terminal pairs, and a bottom end of the base portion 21 passes downward beyond the signal terminal pairs. The base portion 21 has a through hole 211 and a bending portion 212 located above the through hole 211. The through hole 211 runs through the base portion 21 in the left-right direction. The bending portion 212 is formed by extending upward and bending and extending forward. That is, the bending portion 212 is L-shaped. The bending portion 212 protrudes out of the top surface 103, and is provided with a guidance portion 2121 at a front end thereof close to the front end surface 101. The guidance portion 2121 is located in front of the through hole 211, and a width of the guidance portion 2121 in the left-right direction gradually reduces forward from rear thereof (also referring to FIG. 8).

As shown in FIG. 4, FIG. 8 and FIG. 10, a first contact arm 22 and a second contact arm 23 extend forward from the base portion 21. The first contact arm 22 is located at an upper side of the mating slot 11, and the second contact arm 23 is located at a lower side of the mating slot 11. The first contact arm 22 is downward provided with a first conductive portion 221, and the second contact arm 23 is upward provided with a second conductive portion 231. The first conductive portion 221 and the second conductive portion 231 are provided to be staggered in the front-rear direction. The first conductive portion 221 and the second conductive portion 231 respectively protrude into the mating slot 11 to mate with the mating member 200.

As shown in FIG. 4, FIG. 8 and FIG. 10, a soldering portion 24 is formed by extending backward from the base portion 21. The soldering portion is exposed backward to the insulating body 1 to be soldered with the circuit board 300, forming an electrical connection therebetween. A bottom end of the base portion 21 passes downward beyond the soldering portion 24. The soldering portion 24 and the through hole 211 are provided to align in the front-rear direction. The soldering portion 24 is provided lower than the bending portion 212 in the vertical direction, and a bottom surface of the soldering portion 24 in the vertical direction is higher than a lowest point of the second contact arm 23 in the vertical direction.

Figure 7:
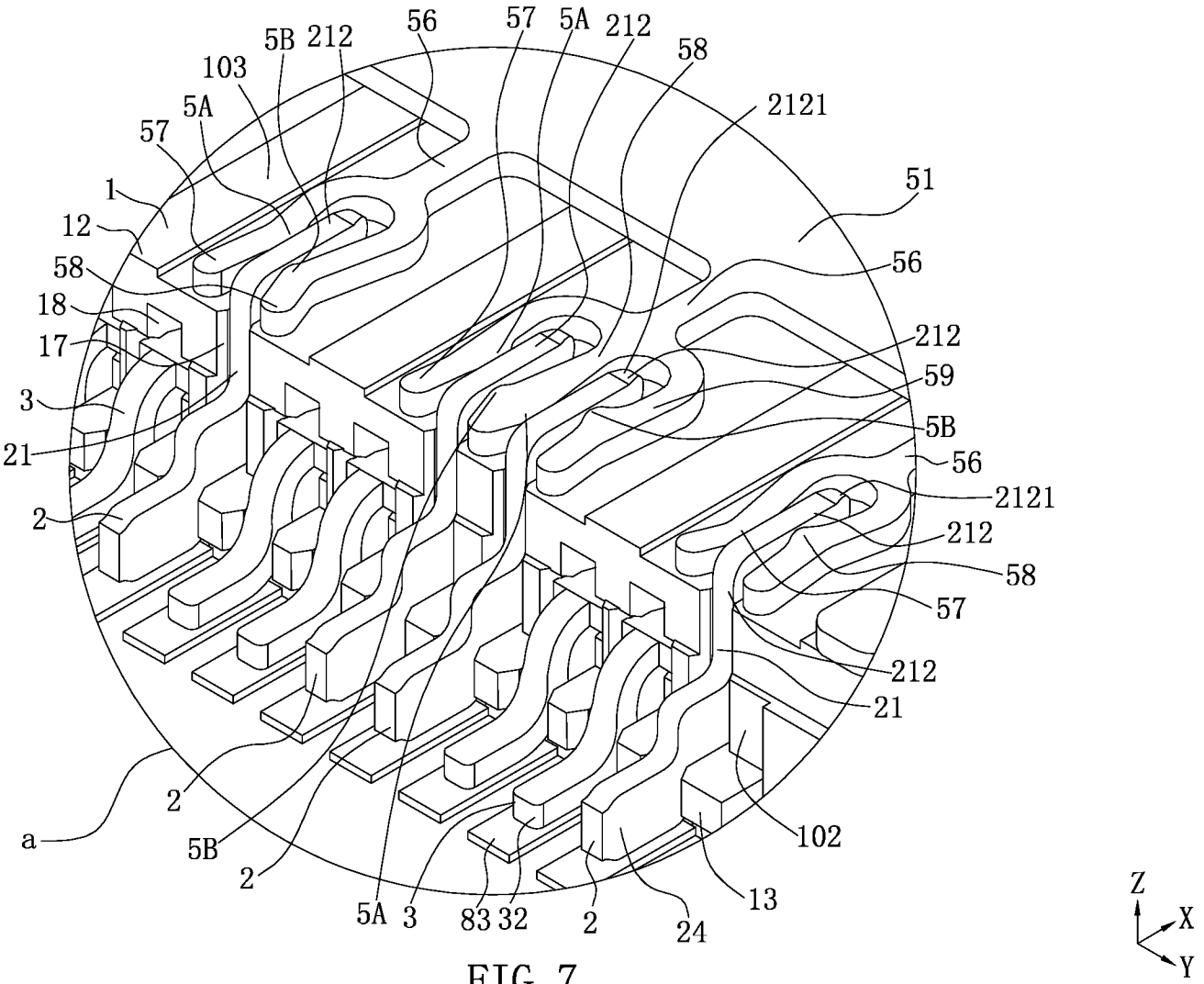
FIG. 7 is a partial enlarged view of a portion a in FIG. 6.

As shown in FIG. 4, FIG. 7 and FIG. 11, each signal terminal 3 is a structure formed by punching and bending a metal plate. Each signal terminal 3 extends forward to form a conductive arm 31. The conductive arm 31 is located at the upper side of the mating slot 11. The conductive arm 31 is downward provided with a conducting portion 311 protruding into the mating slot 11 to be conductively connected to the mating member 200. Each signal terminal 3 is provided with a soldering leg 32 exposed backward to the insulating body 1 to be electrically connected to the circuit board 300.

As shown in FIG. 4, FIG. 6 and FIG. 12, each retaining member 4 is inserted forward from rear thereof into a corresponding mounting slot 16. Each retaining member 4 is provided with a retaining portion 41 retained to the corresponding mounting slot 16, and an arm portion 42 formed by extending forward from the retaining portion 41. The arm portion 42 is provided with an abutting portion 421 and a buckling portion 422 connected to the abutting portion 421. The abutting portion 421 is located at a front end of the arm portion 42, and the buckling portion 422 is formed by protruding upward from the abutting portion 421 toward the mating slot 11.

Figure 5:
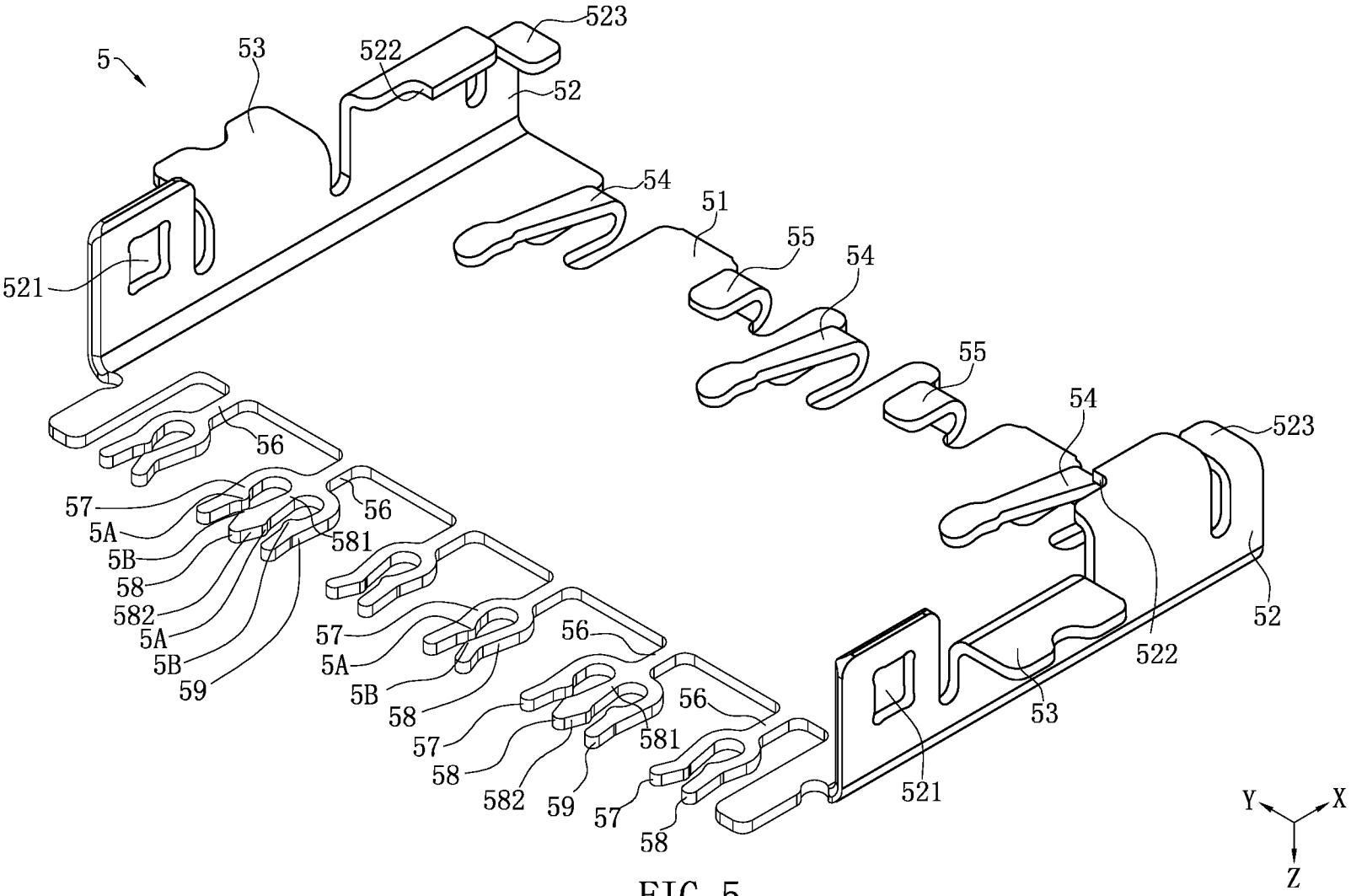
FIG. 5 is a perspective view of the metal shell of the electrical connector in FIG. 4 being 180° inversed.

As shown in FIG. 4, FIG. 5 and FIG. 6, the metal shell 5 is formed by punching a metal plate, and is mounted outside the insulating body 1 backward from front thereof. The metal shell 5 has a top plate 51 located above the insulating body 1, and two side plates 52 formed by respectively bending and extending downward from a left side and a right side of the top plate 51. The two side plates 52 are correspondingly provided and covering outside the two side walls 15.

As shown in FIG. 2, FIG. 5 and FIG. 11, the metal shell 5 has a plurality of elastic portions 54 connected to the top plate 51. Each elastic portion 54 is formed by bending and extending downward and backward from a front end of the top plate 51. Each elastic portion 54 passes through a corresponding first groove 121 to be downward conductively connected to the mating member 200.

As shown in FIG. 2, FIG. 5 and FIG. 10, a plurality of clip portions 55 are formed by bending and extending downward and backward from the front end of the top plate 51. Each clip portion 55 is located between two elastic portions 54 in the left-right direction. Each clip portion 55 protrudes into a corresponding second groove 122 to clip to the insulating body 1, thus preventing the metal shell 5 from detaching and falling. The clip portions 55 are located behind the front end surface 101.

As shown in FIG. 5, FIG. 7 and FIG. 8, a plurality of neck portions 56 are formed by extending backward from a rear end of the top plate 51. The neck portions 56 and the elastic portions 54 are provided to be staggered in the front-rear direction. Some of the neck portions 56 extend backward respectively to form a first elastic arm 57, a second elastic arm 58 and a third elastic arm 59. Each neck portion 56 and the corresponding second elastic arm 58 are provided to align in the front-rear direction, and the first elastic arm 57 and the third elastic arm 59 are symmetrical in the left-right direction relative to the neck portions 56. The second elastic arm 58 is located between the first elastic arm 57 and the third elastic arm 59. One ground terminal 2 is located between the first elastic arm 57 and the second elastic arm 58 in the left-right direction, and another ground terminal 2 is located between the second elastic arm 58 and the third elastic arm 59 in the left-right direction. Thus, the ground terminal 2 located between the first elastic arm 57 and the second elastic arm 58 and the ground terminal 2 located between the second elastic arm 58 and the third elastic arm 59 are provided to be adjacent to each other in the left-right direction. One of the signal terminal pairs is located at a left side of the first elastic arm 57, and is adjacent to one side of the two adjacent ground terminals 2. Another signal terminal pair is located at a right side of the third elastic arm 59, and is adjacent to the other side of the two adjacent ground terminals 2.

As shown in FIG. 5, FIG. 7 and FIG. 8, each of the first elastic arm 57 and the second elastic arm 58 has a first contact portion 5A provided rightward, and each of the second elastic arm 58 and the third elastic arm 59 has a second contact portion 5B provided leftward. The first contact portion 5A of the first elastic arm 57 and the second contact portion 5B of the second elastic arm 58 are provided to be staggered in the front-rear direction, and the first contact portion 5A of the second elastic arm 58 and the second contact portion 5B of the third elastic arm 59 are provided to be staggered in the front-rear direction. The first contact portion 5A of the first elastic arm 57 and the second contact portion 5B of the third elastic arm 59 align with each other in the left-right direction, and the first contact portion 5A and the second contact portion 5B of the second elastic arm 58 align with each other in the left-right direction. The first contact portion 5A of the first elastic arm 57 rightward abuts one of the two adjacent ground terminals 2, and the second contact portion 5B of the second elastic arm 58 leftward abuts the one of the two adjacent ground terminals 2. The first contact portion 5A of the second elastic arm 58 rightward abuts the other of the two adjacent ground terminals 2, and the second contact portion 5B of the third elastic arm 59 leftward abuts the other of the two adjacent ground terminals 2. The first contact portions 5A and the second contact portions 5B are in contact with the bending portions 212 of the corresponding ground terminals 2 above the top wall 12, and a top end of the bending portion 212 is higher than the first contact portions 5A and the second contact portions 5B in the vertical direction. The guidance portion 2121 of one of the two ground terminals 2 is used to guide the corresponding base portion 21 of the one of the two ground terminals 2 forward to be inserted between the first elastic arm 57 and the second elastic arm 58, and is located in front of the first contact portion 5A of the first elastic arm 57 and the second contact portion 5B of the second elastic arm 58. The guidance portion 2121 of the other of the two ground terminals 2 is used to guide the base portion 21 of the other of the two ground terminals 2 forward to be inserted between the second elastic arm 58 and the third elastic arm 59, and is located in front of the first contact portion 5A of the second elastic arm 58 and the second contact portion 5B of the third elastic arm 59.

Figure 15:
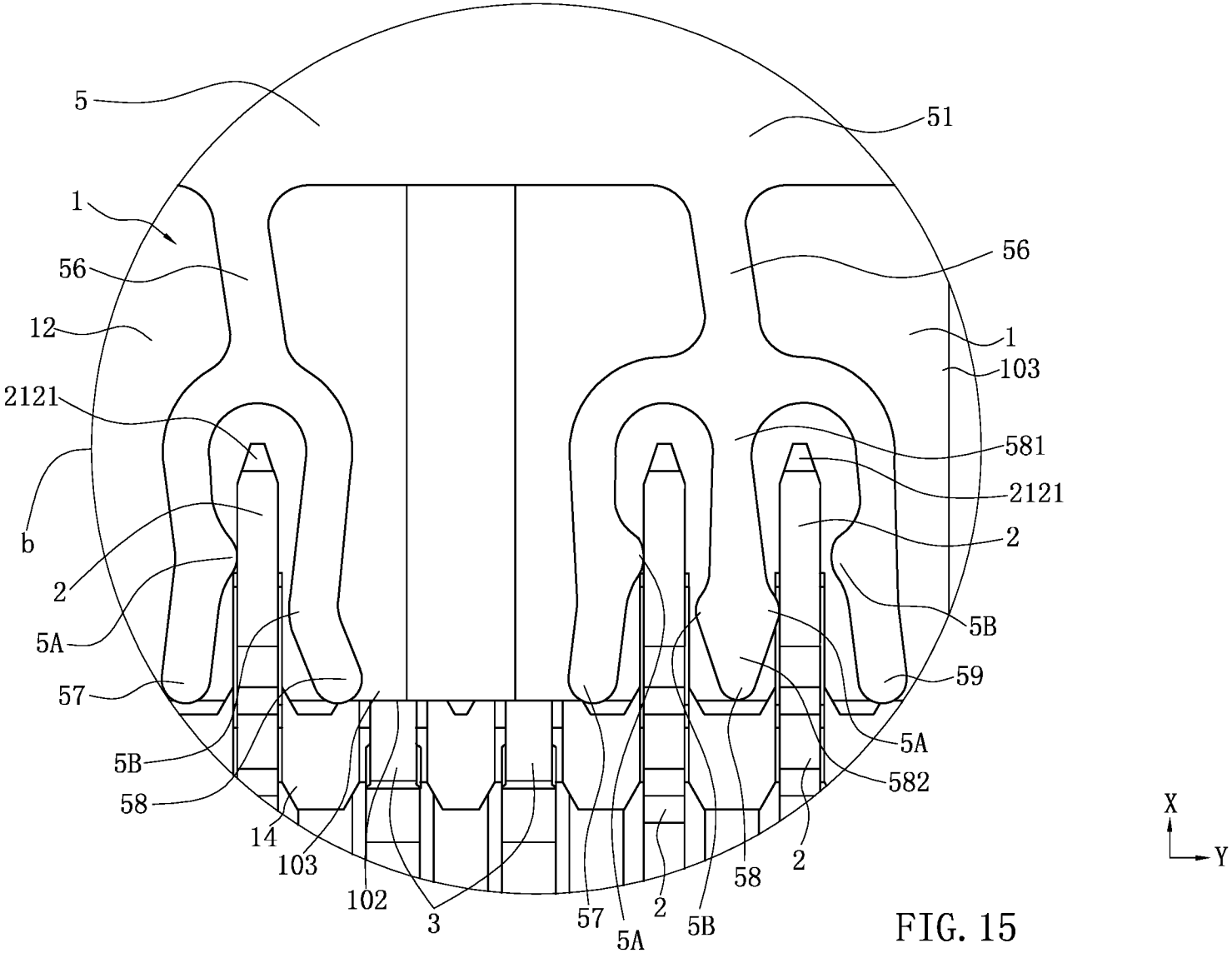
FIG. 15 is a partial enlarged view of a portion b in FIG. 14.

As shown in FIG. 5, FIG. 8 and FIG. 15, the second elastic arm 58 is provided with an extending portion 581 connected to the neck portion 56. A width of the extending portion 581 in the left-right direction is less than a distance between the first contact portion 5A and the second contact portion 5B of the second elastic arm 58.

As shown in FIG. 5, FIG. 8 and FIG. 15, the second elastic arm 58 is provided with a guiding portion 582 connecting the first contact portion 5A and the second contact portion 5B thereon. The guiding portion 582 is used to guide the second elastic arm 58 to be inserted backward between the two adjacent ground terminals 2. The guiding portion 582 is located behind the first contact portion 5A and the second contact portion 5B of the second elastic arm 58. In this embodiment, a width of the guiding portion 582 in the left-right direction is less than a distance between the two adjacent ground terminals 2.

Figure 14:
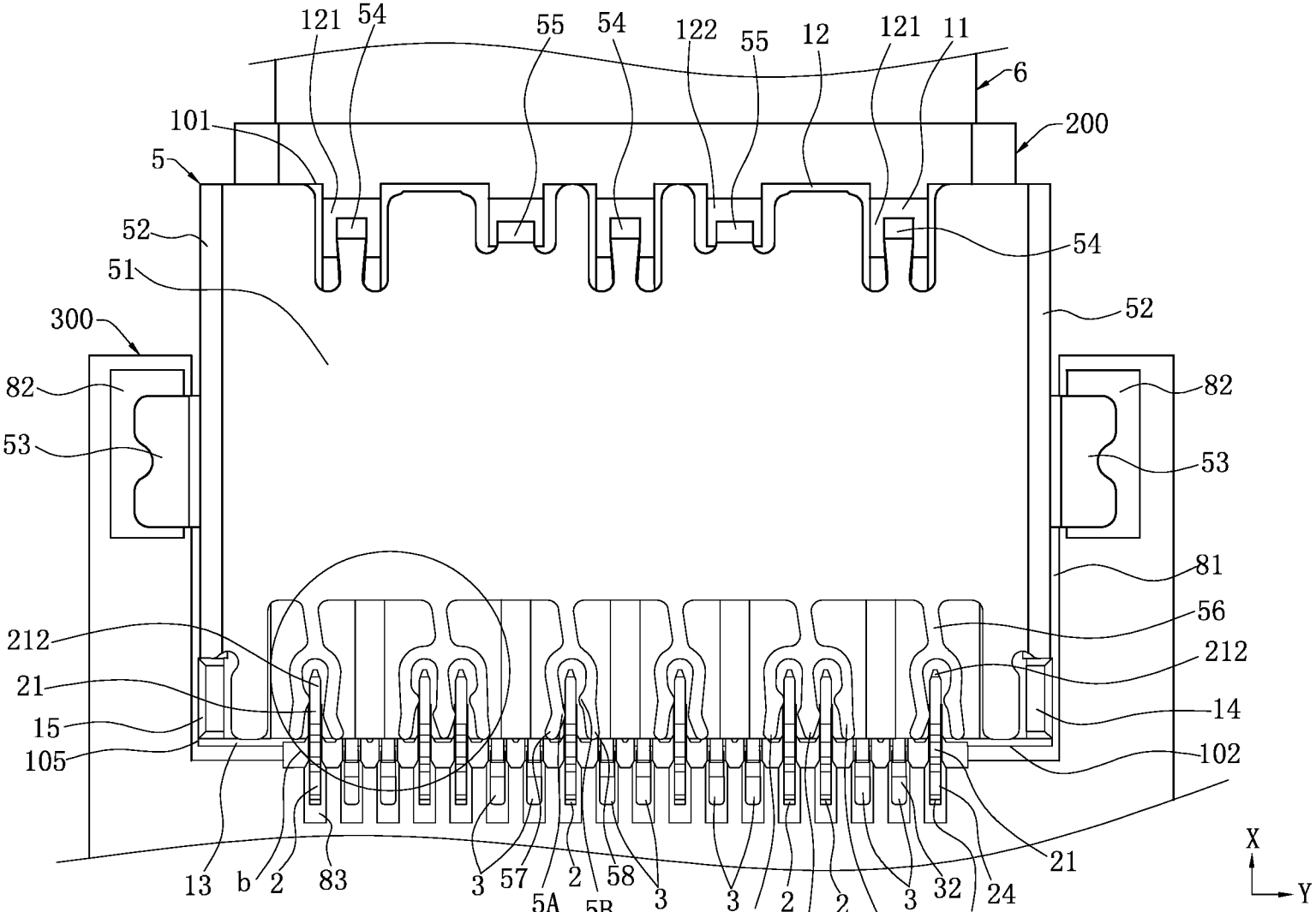
FIG. 14 is a schematic view of the neck portion of the metal shell in FIG. 8 deviating rightward.

As shown in FIG. 8, FIG. 14 and FIG. 15, when the neck portion 56 deviates rightward, the first contact portion 5A of the first elastic arm 57 rightward abuts one of the two ground terminals 2, the second contact portion 5B of the second elastic arm 58 does not leftward abut the one of the two ground terminals 2, the first contact portion 5A of the second elastic arm 58 rightward abuts the other of the two ground terminals 2, and the second contact portion 5B of the third elastic arm 59 does not leftward abut the other of the two ground terminals 2, such that the metal shell 5 maintains electrically connected with each of the ground terminals 2.

Figure 16:
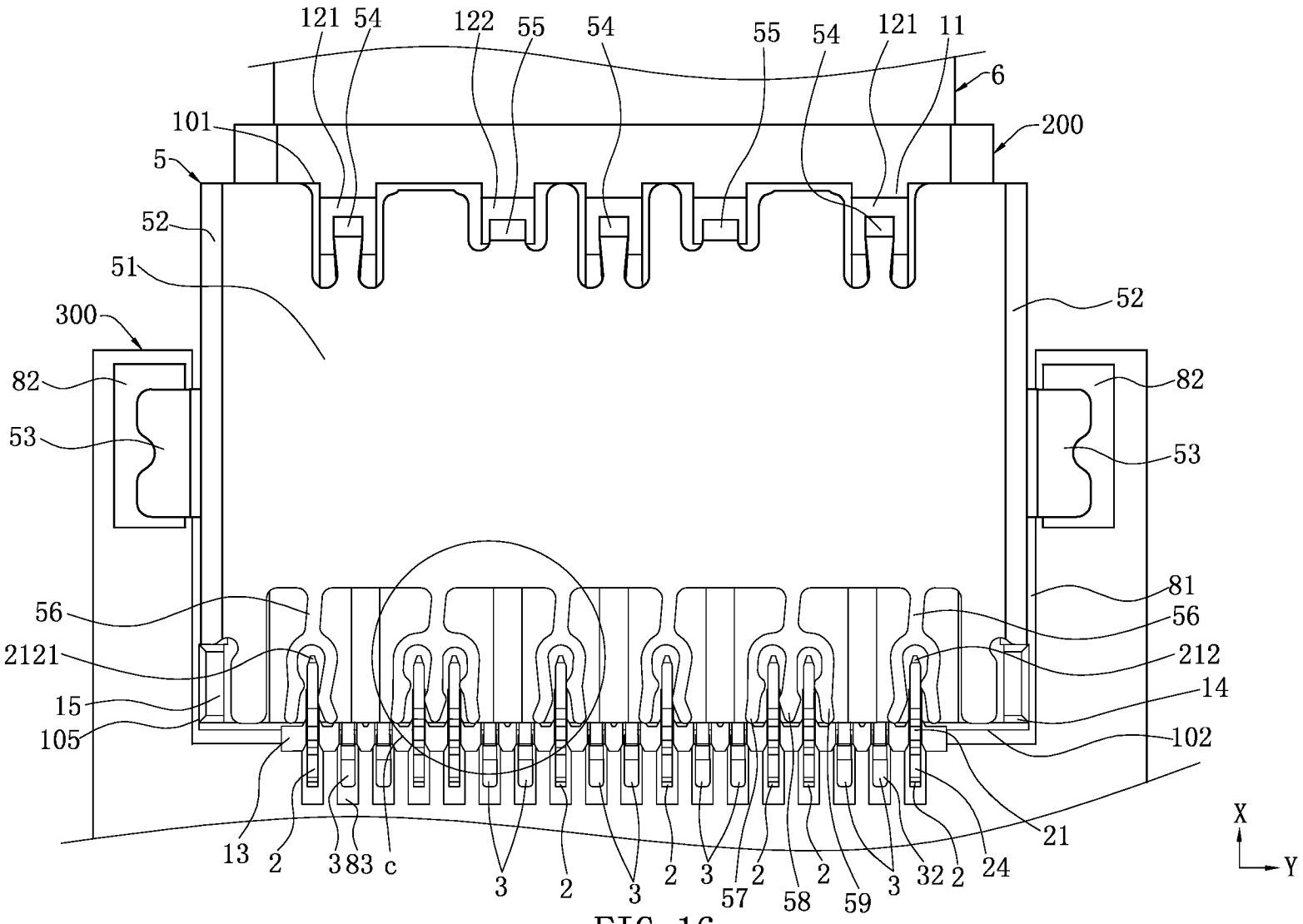
FIG. 16 is a schematic view of the neck portion of the metal shell in FIG. 8 deviating leftward.
Figure 17:
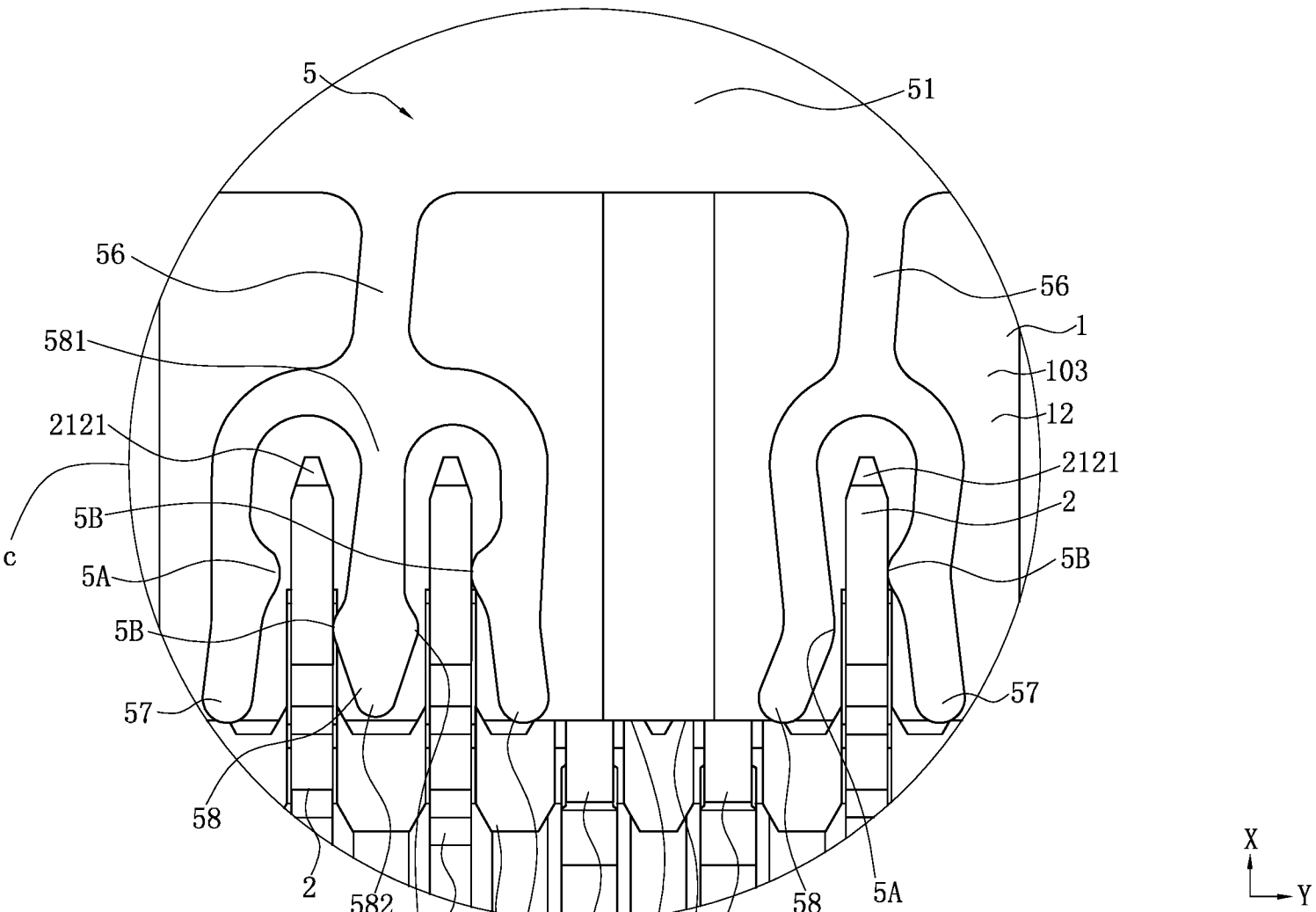
FIG. 17 is a partial enlarged view of a portion c in FIG. 16.

As shown in FIG. 8, FIG. 16 and FIG. 17, when the neck portion 56 deviates leftward, the second contact portion 5B of the second elastic arm 58 leftward abuts the one of the two ground terminals 2, the first contact portion 5A of the first elastic arm 57 does not rightward abut the one of the two ground terminals 2, the second contact portion 5B of the third elastic arm 59 leftward abuts the other of the two ground terminals 2, and the first contact portion 5A of the second elastic arm 58 does not rightward abut the other of the two ground terminals 2, such that the metal shell 5 maintains electrically connected with each of the ground terminals 2.

As shown in FIG. 8, FIG. 15 and FIG. 17, regardless of whether the neck portion 56 deviates rightward or leftward in the left-right direction, it is ensured that the two first contact portions 5A or the two second contact portions 5B are in contact with the two adjacent ground terminals 2, thus ensuring stable electrical connection between the metal shell 5 and each of the ground terminals 2.

As shown in FIG. 8, FIG. 15 and FIG. 17, some others of the neck portions 56 extend backward respectively to only form the first elastic arm 57 and the second elastic arm 58, and the second elastic arm 58 is only provided with the second contact portion 5B provided leftward. In this case, the first contact portion 5A of the first elastic arm 57 and the second contact portion 5B of the second elastic arm 58 face toward each other to be in contact with the bending portion 212 of a same ground terminal 2, which may also facilitate the feature as described above in which, regardless of whether the neck portion 56 deviates rightward or leftward in the left-right direction, it is ensured that the metal shell 5 has a contact point to be in contact with each of the ground terminals 2, thus facilitating stable electrical connection between the metal shell 5 and each of the ground terminals 2.

As shown in FIG. 2, FIG. 3 and FIG. 5, each side plate 52 is provided with a buckling hole 521 running through the side plate 52 in the left-right direction. When the metal shell 5 is mounted to the insulating body 1 backward from front thereof, the buckling holes 521 are buckled to the corresponding protruding blocks 19. A lower edge of each side plate 52 extends inward to form a first stopping portion 522 and a second stopping portion 523 located at the bottom portion of the insulating body 1. The first stopping portion 522 is located behind the second stopping portion 523. The first stopping portion 522 and the second stopping portion 523 are provided at an interval in the front-rear direction, and are staggered in the vertical direction. In this embodiment, the first stopping portion 522 is provided lower than the second stopping portion 523. The lower edge of each side plate 52 extends outward to form a grounding leg 53. The grounding leg 53 is located behind the first stopping portion 522, and the grounding leg 53 is soldered to the circuit board 300, such that the metal shell 5 and circuit board 300 form a grounding connection.

As shown in FIG. 2, FIG. 3 and FIG. 12, the pushing member 6 has a connecting portion 61. The connecting portion 61 is provided with an operating portion 611 and a fixing portion 612 connected to the operating portion 611. The operating portion 611 is located in front of the front end surface 101, and the fixing portion 612 is located behind the operating portion 611. Further, a width of the fixing portion 612 in the left-right direction is less than a width of the operating portion 611 in the left-right direction. The fixing portion 612 is accommodated in the accommodating slot 131.

Figure 13:
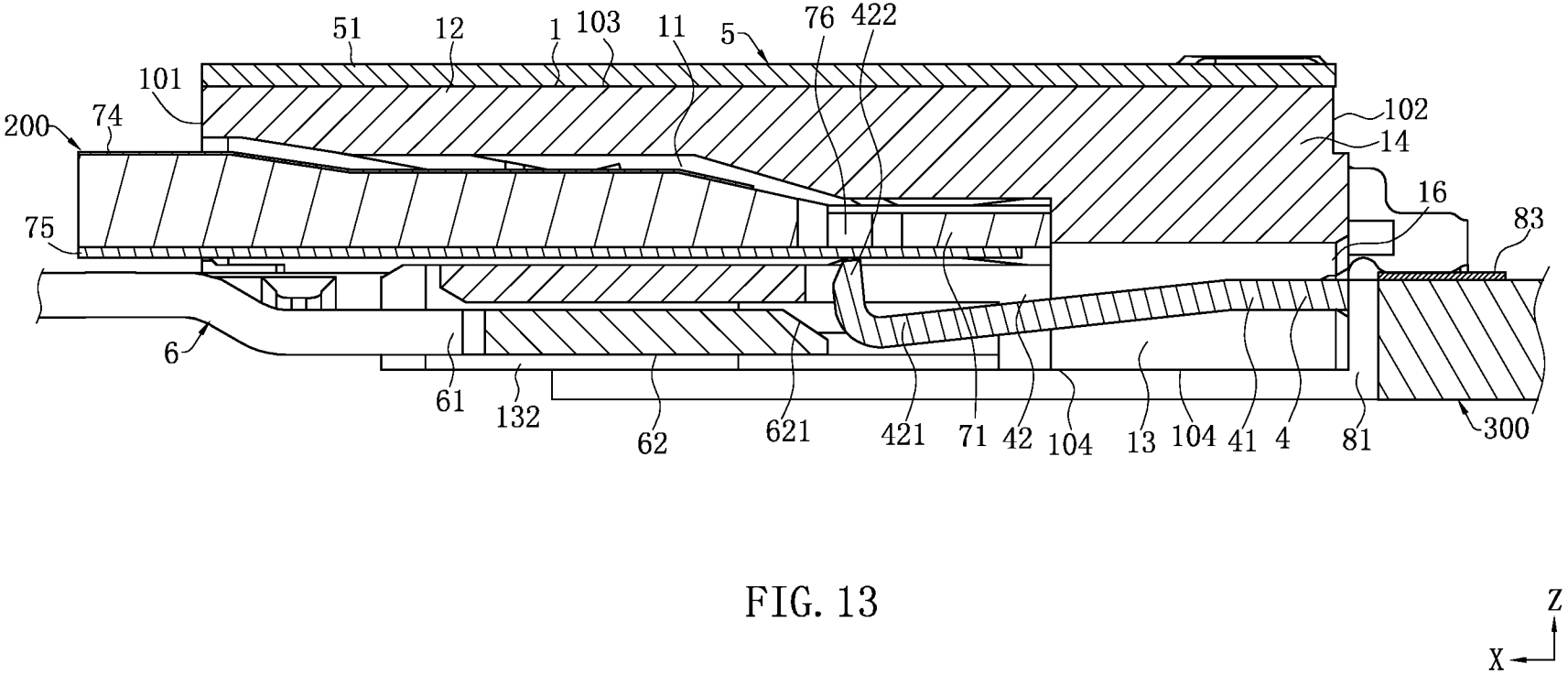
FIG. 13 is a schematic view of the retaining members releasing the mating member in FIG. 12.

As shown in FIG. 2 and FIG. 3, two pushing portions 62 are formed by respectively extending backward from a left side and a right side of the operating portion 611. The two pushing portions 62 are respectively located at a left side and a right side of the fixing portion 612, and are one-to-one accommodated in the two sliding slots 132. Each pushing portion 62 is provided to be at an interval with the fixing portion 612 in the left-right direction, and passes backward beyond the fixing portion 612. Each pushing portion 62 is provided with a guiding chamfer 621, a first position limiting portion 622 located in front of the guiding chamfer 621, and a second position limiting portion 623 located in front of the first position limiting portion 622. The first position limiting portion 622 and the second position limiting portion 623 are provided at an interval in the front-rear direction and staggered in the vertical direction. The guiding chamfer 621 is formed by being provided behind each pushing portion 62 and extending backward and downward. As shown in FIG. 3 and FIG. 12, after the mating member 200 is inserted into the mating slot 11, the operating portion 611 is operated such that the pushing member 6 moves backward relative to the insulating body 1. The guiding chamfer 621 guides each pushing portion 62 to be located below the corresponding abutting portion 421 and to push the abutting portion 421 upward, and the buckling portion 422 is correspondingly pushed to protrude into the mating slot 11, such that the buckling portion 422 is buckled with the mating member 200, thus preventing the mating member 200 from moving forward and detaching from being in contact with the terminal. The first stopping portion 522 is located in front of the first position limiting portion 622 and the two are not in contact with each other. The second stopping portion 523 is located in front of the second position limiting portion 623 to limit the pushing member 6 from moving forward. As shown in FIG. 13, when the pushing member 6 moves forward relative to the insulating body 1, each pushing portion 62 moves forward to correspondingly detach from the abutting portion 421, and the buckling portion 422 moves downward to be released from buckling with the mating member 200, such that the mating member 200 is retracted from the mating slot 11. The first stopping portion 522 stops the first position limiting portion 622 to prevent the pushing member 6 from excessively moving forward. The second stopping portion 523 is located behind the second position limiting portion 623 to prevent the pushing member 6 from sliding backward to cause the mating member 200 not being capable of retreating.

As shown in FIG. 1, FIG. 10 and FIG. 11, the mating member 200 is provided with a mating end 71. An upper surface of the mating end 71 is provided with a plurality of signal conductive sheets 72 and a plurality of grounding conductive sheets 73 provided in a row in the left-right direction. One grounding conductive sheet 73 is provided between two pairs of signal conductive sheets 72. Each grounding conductive sheet 73 is used for a corresponding first conductive portion 221 to be downward conductively connected thereto, or used for two corresponding adjacent first conductive portions 221 to be downward conductively connected thereto altogether. The conducting portions 311 are one-to-one correspondingly downward conductively connected to the signal conductive sheets 72. The mating member 200 has an upper shielding member 74 covering an upper side of the mating member 200 and a lower shielding member 75 covering a lower side of the mating member 200. The upper shielding member 74 is located in front of the mating end 71. The lower shielding member 75 extends backward from front thereof to be below the mating end 71. The elastic portions 54 downward abut the upper shielding member 74. The second conductive portions 231 upward abut the lower shielding member 75. Two buckling slots 422 are respectively provided at the left side and the right side of the mating member 200. Each buckling slot 422 is substantially provided at a side edge of the mating end 71 close to the front. As shown in FIG. 12, when the pushing member 6 moves backward, the buckling portion 422 moves upward and protrudes into a corresponding buckling slot 76, preventing the mating member 200 from moving forward and detaching from being in contact with the terminal. As shown in FIG. 13, when the pushing member 6 moves forward, the buckling portion 422 moves downward and retreats from the corresponding buckling slot 76, such that the mating member 200 retreats from the mating slot 11.

As shown in FIG. 1, FIG. 4 and FIG. 10, the circuit board 300 is provided with a notch 81 running vertically through the circuit board 300, and a plurality of grounding pads 82 and a plurality of conductive pads 83 located on an upper surface of the circuit board 300. In this embodiment, two grounding pads 82 are provided, and are respectively located at a left side and a right side of the notch 81. The conductive pads 83 are located at a back side of the notch 81. The bottom wall 13 is lower than the upper surface of the circuit board 300 in the vertical direction and is downward accommodated in the notch 81, thus facilitating reducing the height of the product. The bottom end of the base portion 21 in the vertical direction is lower than the upper surface of the circuit board 300. The conductive pads 83 are higher than a lowest point of the second contact arm 23 in the vertical direction. The two grounding legs 53 one-to-one correspond to the two grounding pads 82. The soldering portions 24 and the soldering legs 32 are correspondingly soldered to the conductive pads 83.

In sum, the electrical connector according to certain embodiments of the present invention has the following beneficial effects:

(1) The neck portions 56 extend backward from the top plate 51 of the metal shell 5, and some of the neck portions 56 extend backward respectively to form the first elastic arm 57, the second elastic arm 58 and the third elastic arm 59. One of the ground terminals 2 is located between the first contact portion 5A of the first elastic arm 57 and the second contact portion 5B of the second elastic arm 58, and the other of the ground terminals 2 is located between the first contact portion 5A of the second elastic arm 58 and the second contact portion 5B of the third elastic arm 59. When the neck portion 56 deviates rightward, the first contact portion 5A of the first elastic arm 57 rightward abuts one of the ground terminals 2, and the first contact portion 5A of the second elastic arm 58 rightward abuts the other of the ground terminals 2. When the neck portion 56 deviates leftward, the second contact portion 5B of the second elastic arm 58 leftward abuts the one of the ground terminals 2, and the second contact portion 5B of the third elastic arm 59 leftward abuts the one of the ground terminals 2. The first contact portion 5A and the second contact portion 5B are provided to be staggered in the front-rear direction, facilitating increasing a distance between the first contact portion 5A of the first elastic arm 57 and the second elastic arm 58, increasing a distance between the first contact portion 5A of the second elastic arm 58 and the third elastic arm 50 and a distance between the second contact portion 5B of the second elastic arm 58 and the first elastic arm 57, and increasing a distance between the second contact portion 5B of the third elastic arm 59 and the second elastic arm 58, such that a thickness of the punch in the left-right direction is greater than the width of the metal plate forming the first contact portions 5A and the second contact portions 5B, the punch does not easily break, and the usage life of the punch is increased. When the metal shell 5 deviates rightward or leftward, due to the existence of the neck portion 56, which may elastic deform in the left-right direction, thus further providing a swinging force in the left-right direction, facilitating reducing the degree of the elastic leftward or rightward deviations of the first elastic arm 57, the second elastic arm 58 and the third elastic arm 59, such that the normal force applied to the two ground terminals 2 by the first contact portions 5A and the second contact portions 5B before and after the metal shell 5 deviates does not significantly change, thereby increasing the usage lives of the first elastic arm 57, the second elastic arm 58 and the third elastic arm 59, and ensuring the metal shell 5 to have a contact point with each ground terminal 2, thereby achieving the stable electrical connection therebetween, such that the electrical connector 100 achieves the high frequency characteristics and satisfies higher usage requirements.

(2) Each ground terminal 2 is provided with the base portion 21 accommodated in the insulating body 1. The base portion 21 protrudes upward out of the upper surface of the insulating body 1 and is higher than the first contact portions 5A and the second contact portions 5B, facilitating the first contact portions 5A to rightward abut the ground terminals 2 and the second contact portions 5B to leftward abut the ground terminals 2.

(3) Each base portion 21 has the guidance portion 2121 exposed upward out of the insulating body 1. The guidance portion 2121 of one of the two ground terminals 2 is used to guide the corresponding base portion 21 of the one of the two ground terminals 2 forward to be inserted between the first elastic arm 57 and the second elastic arm 58, and is located in front of the first contact portion 5A of the first elastic arm 57 and the second contact portion 5B of the second elastic arm 58. The guidance portion 2121 of the other of the two ground terminals 2 is used to guide the base portion 21 of the other of the two ground terminals 2 forward to be inserted between the second elastic arm 58 and the third elastic arm 59, and is located in front of the first contact portion 5A of the second elastic arm 58 and the second contact portion 5B of the third elastic arm 59, thus facilitating the guidance of the ground terminals 2 to be inserted between the corresponding two elastic arms when the metal shell 5 is mounted backward from front thereof to the insulating body 1.

(4) The top end of each ground terminal 2 passes upward beyond the signal terminal pairs, and the bottom end of each ground terminal 2 passes downward beyond the signal terminal pairs, thus strengthening the shielding effect of the ground terminals 2 to the signal terminals 3 and reducing crosstalk.

(5) Each pushing portion 62 is provided with the first position limiting portion 622 and the second position limiting portion 623. The first position limiting portion 622 and the second position limiting portion 623 are provided at an interval in the front-rear direction and staggered in the vertical direction. The left side and the right side of the metal shell 5 are respectively provided with a first stopping portion 522 and a second stopping portion 523 located at the bottom portion of the insulating body 1. The second stopping portion 523 and the first stopping portion 522 are provided at an interval in the front-rear direction, and are staggered in the vertical direction. When the buckling portion 422 is buckled to the mating member 200, the first stopping portion 522 is located in front of the first position limiting portion 622 and the two are provided at an interval, and the second stopping portion 523 is located in front of the second position limiting portion 623 to limit the pushing member 6 from moving forward. When the buckling portion 422 is released from buckling with the mating member 200, the first stopping portion 522 stops the first position limiting portion 622 to limit the pushing member 6 from excessively moving forward, and the second stopping portion 523 is located behind the second position limiting portion 623 to limit the pushing member 6 from moving backward, thus preventing the pushing member 6 from excessively moving forward and detaching from the insulating body 1, and preventing the pushing member 6 from sliding backward to cause the mating member 200 not being capable of retreating.

(6) Each neck portion 56 and the corresponding second elastic arm 58 are provided to align in the front-rear direction. When the neck portion 56 moves leftward or rightward, the neck portion 56 allows the first elastic arm 57, the second elastic arm 58 and the third elastic arm 59 to be applied with uniform forces.

(7) The second elastic arm 58 is provided with the extending portion 581 connected to the neck portion 56. A width of the extending portion 581 in the left-right direction is less than a distance between the first contact portion 5A and the second contact portion 5B of the second elastic arm 58. Utilizing the principle of moments, the second elastic arm 58 may easily swing in the left-right direction, facilitating the first contact portion 5A and the second contact portion 5B of the second elastic arm 58 to be conductively connected with the ground terminals 2.

(8) The second elastic arm 58 is provided with the guiding portion 582 to guide the second elastic arm 58 to be inserted backward between the two adjacent ground terminals 2. The guiding portion 582 is located behind the first contact portion 5A and the second contact portion 5B of the second elastic arm 58. A width of the guiding portion 582 in the left-right direction is less than a distance between the two adjacent ground terminals 2, facilitating the second elastic arm 58 to be inserted between the two adjacent ground terminals 2, and preventing the second elastic arm 58 from wrapping.

(9) Two retaining members 4 are respectively provided at a left side and a right side of the insulating body 1. The pushing member 6 is provided with the connecting portion 61 and two pushing portions 62 formed by respectively extending backward from a left side and a right side of the connecting portion 61. When the pushing member 6 moves backward, the two pushing portions 62 one-to-one correspondingly abut the two abutting portions 421 of the two retaining members 4, and the two buckling portions 422 of the two retaining members 4 are pushed to buckle with the buckling slots 76 of the mating member 200 correspondingly. When the pushing member 6 moves forward, the two pushing portions 62 move forward to correspondingly detach from the two abutting portions 421 of the two retaining members 4, and the two buckling portions 422 of the two retaining members 4 are released from buckling with the mating member 200, facilitating increasing the retaining force of the mating member 200 in the insulating body 1 when being mated with the terminals, and preventing the mating member 200 from detaching and falling.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to mate with a mating member, the electrical connector comprising:

an insulating body, provided with a front end surface, wherein a mating slot is formed by being backward concavely provided on the front end surface to be inserted by the mating member;

a plurality of terminals, provided on the insulating body, wherein the terminals comprise two signal terminal pairs and two adjacent ground terminals located between the two signal terminal pairs, and each of the two signal terminal pairs comprises two signal terminals configured to transmit differential signals; and a metal shell, provided and covering outside the insulating body, wherein the metal shell comprises a top plate located above the insulating body, a neck portion formed by extending backward from the top plate, and a first elastic arm, a second elastic arm and a third elastic arm formed by respectively extending backward from the neck portion, the second elastic arm is located between the first elastic arm and the third elastic arm, each of the first elastic arm and the second elastic arm has a first contact portion provided rightward, each of the second elastic arm and the third elastic arm has a second contact portion provided leftward, the first contact portion of the first elastic arm and the second contact portion of the second elastic arm are provided to be staggered in a front-rear direction, the first contact portion of the second elastic arm and the second contact portion of the third elastic arm are provided to be staggered in the front-rear direction, one of the two adjacent ground terminals is located between the first contact portion of the first elastic arm and the second contact portion of the second elastic arm, and the other of the two adjacent ground terminals is located between the first contact portion of the second elastic arm and the second contact portion of the third elastic arm;

wherein when the neck portion deviates rightward, the first contact portion of the first elastic arm rightward abuts the one of the two adjacent ground terminals, and the first contact portion of the second elastic arm rightward abuts the other of the two adjacent ground terminals; and when the neck portion deviates leftward, the second contact portion of the second elastic arm leftward abuts the one of the two adjacent ground terminals, and the second contact portion of the third elastic arm leftward abuts the other of the two adjacent ground terminals.

2. The electrical connector according to claim 1, wherein each of the ground terminals is provided with a base portion accommodated in the insulating body, and the base portion protrudes upward out of an upper surface of the insulating body and is higher than the first contact portion and the second contact portion.

3. The electrical connector according to claim 2, wherein a first contact arm and a second contact arm extend forward from the base portion, the first contact arm has a first conductive portion located at an upper side of the mating slot, the second contact arm has a second conductive portion located at a lower side of the mating slot, the first conductive portion and the second conductive portion are configured to mate with the mating member, a soldering portion extends backward from the base portion to be soldered with a circuit board, and a bottom surface of the soldering portion is higher than a lowest point of the second contact arm.

4. The electrical connector according to claim 3, wherein the first conductive portion and the second conductive portion are provided to be staggered in the front-rear direction.

5. The electrical connector according to claim 2, wherein the base portion of each of the two ground terminals has a guidance portion formed by extending forward and exposed upward out of the insulating body, the guidance portion of one of the two ground terminals is configured to guide the base portion of the one of the two ground terminals forward to be inserted between the first elastic arm and the second elastic arm and is located in front of the first contact portion of the first elastic arm and the second contact portion of the second elastic arm, and the guidance portion of the other of the two ground terminals is configured to guide the base portion of the other of the two ground terminals forward to be inserted between the second elastic arm and the third elastic arm and is located in front of the first contact portion of the second elastic arm and the second contact portion of the third elastic arm.

6. The electrical connector according to claim 1, wherein a top end of each of the two ground terminals passes upward beyond the two signal terminal pairs, and a bottom end of each of the two ground terminals passes downward beyond the two signal terminal pairs.

7. The electrical connector according to claim 1, wherein the metal shell further comprises at least one elastic portion connected to the top plate, the at least one elastic portion and the neck portion are provided to be staggered in the front-rear direction, the mating member is provided with an upper shielding member, and the at least one elastic portion protrudes into the mating slot to downward abut the upper shielding member.

8. The electrical connector according to claim 1, wherein one of the two signal terminal pairs is located at a left side of the first elastic arm, and the other of the two signal terminal pairs is located at a right side of the third elastic arm.

9. The electrical connector according to claim 1, wherein the neck portion and the second elastic arm are provided to align in the front-rear direction.

10. The electrical connector according to claim 1, wherein the first elastic arm and the third elastic arm are symmetrical in a left-right direction relative to the neck portion.

11. The electrical connector according to claim 1, wherein the second elastic arm is provided with an extending portion connected to the neck portion, a width of the extending portion in a left-right direction is less than a distance between the first contact portion of the second elastic arm and the second contact portion of the second elastic arm.

12. The electrical connector according to claim 1, wherein the second elastic arm is provided with a guiding portion to guide the second elastic arm to be inserted backward between the two adjacent ground terminals, the guiding portion is located behind the first contact portion and the second contact portion of the second elastic arm, and a width of the guiding portion in a left-right direction is less than a distance between the two adjacent ground terminals.

13. The electrical connector according to claim 1, wherein the first contact portion of the first elastic arm and the second contact portion of the third elastic arm align in a left-right direction, and the first contact portion of the second elastic arm and the second contact portion of the second elastic arm align in the left-right direction.

14. The electrical connector according to claim 1, further comprising a pushing member and at least one retaining member, wherein the at least one retaining member is retained to the insulating body, the retaining member is provided with an arm portion, the arm portion has an abutting portion and a buckling portion, when the pushing member moves backward relative to the insulating body and abuts the abutting portion, the buckling portion is pushed to buckle with the mating member, preventing the mating member from moving forward and detaching from being in contact with the terminals, and when the pushing member moves forward relative to the insulating body and is detached from the abutting portion, the buckling portion is released from buckling with the mating member.

15. The electrical connector according to claim 14, wherein two retaining members are respectively provided at a left side and a right side of the insulating body, the pushing member is provided with a connecting portion and two pushing portions formed by respectively extending backward from a left side and a right side of the connecting portion, when the pushing member moves backward, the two pushing portions one-to-one correspondingly abut the two abutting portions of the two retaining members, and the two buckling portions of the two retaining members are pushed to buckle with the mating member, and when the pushing member moves forward, the two pushing portions move forward to correspondingly detach from the two abutting portions of the two retaining members, and the two buckling portions of the two retaining members are released from buckling with the mating member.

16. The electrical connector according to claim 15, wherein each of the two retaining members comprises a retaining portion connected to the arm portion, the retaining portion is retained to the insulating body, the arm portion is formed by extending forward from the retaining portion, the buckling portion is formed by protruding upward, two buckling slots are respectively provided at a left side and a right side of the mating member, when the pushing member moves backward, the two pushing portions move to be below the two abutting portions of the two retaining members, and the two buckling portions of the two retaining members are pushed to protrude upward into the two buckling slots correspondingly, and when the pushing member moves forward, the two buckling portions of the two retaining members retreat downward from the two buckling slots correspondingly.

17. The electrical connector according to claim 15, wherein each of the two pushing portions is provided with a first position limiting portion, the metal shell is provided with two first stopping portions located at a bottom portion of the insulating body corresponding to the first position limiting portions of the two pushing portions respectively, when the buckling portions of the two retaining members are released from buckling with the mating member, each of the two first stopping portions is located in front of a corresponding one of the first position limiting portions of the two pushing portions to stop the first position limiting portions of the two pushing portions and to prevent the two pushing portions from detaching from the insulating body.

18. An electrical connector, configured to mate with a mating member, the electrical connector comprising:

an insulating body, provided with a front end surface, wherein a mating slot is formed by being backward concavely provided on the front end surface to be inserted by the mating member;

a plurality of terminals, provided on the insulating body, wherein the terminals comprise two signal terminals and at least one ground terminal located between the two signal terminals; and a metal shell, provided and covering outside the insulating body, wherein the metal shell comprises a top plate located above the insulating body, a neck portion formed by extending backward from the top plate, and a first elastic arm and a second elastic arm formed by respectively extending backward from the neck portion, the first elastic arm has a first contact portion provided rightward, the second elastic arm has a second contact portion provided leftward, the first contact portion and the second contact portion are provided to be staggered in a front-rear direction, and one of the at least one ground terminal is located between the first contact portion and the second contact portion;

wherein when the neck portion deviates rightward, the first contact portion rightward abuts the one of the at least one ground terminal, and when the neck portion deviates leftward, the second contact portion leftward abuts the one of the at least one ground terminal.

19. The electrical connector according to claim 18, wherein the ground terminal is provided with a base portion accommodated in the insulating body, and the base portion protrudes upward out of an upper surface of the insulating body and is higher than the first contact portion and the second contact portion.

20. The electrical connector according to claim 19, wherein a first contact arm and a second contact arm extend forward from the base portion, the first contact arm has a first conductive portion located at an upper side of the mating slot, the second contact arm has a second conductive portion located at a lower side of the mating slot, the first conductive portion and the second conductive portion are configured to mate with the mating member, a soldering portion extends backward from the base portion to be soldered with a circuit board, and a bottom surface of the soldering portion is higher than a lowest point of the second contact arm.

21. The electrical connector according to claim 19, wherein the base portion has a guidance portion formed by extending forward, the guidance portion of the one of the at least one ground terminal is configured to guide the base portion of the one of the at least one ground terminal forward to be inserted between the first elastic arm and the second elastic arm.

22. The electrical connector according to claim 18, wherein a top end of the at least one ground terminal passes upward beyond the two signal terminals, and a bottom end of the at least one ground terminal passes downward beyond the two signal terminals.

23. The electrical connector according to claim 18, wherein the terminals comprise two ground terminals located between the two signal terminals, the metal shell further comprises a third elastic arm formed by extending backward from the neck portion, the second elastic arm is located between the first elastic arm and the third elastic arm, each of the first elastic arm and the second elastic arm has a first contact portion provided rightward, each of the second elastic arm and the third elastic arm has a second contact portion provided leftward, the first contact portion of the second elastic arm and the second contact portion of the third elastic arm are provided to be staggered in the front-rear direction, one of the two ground terminals is located between the first contact portion of the first elastic arm and the second contact portion of the second elastic arm, and the other of the two ground terminals is located between the first contact portion of the second elastic arm and the second contact portion of the third elastic arm.

24. The electrical connector according to claim 23, wherein the neck portion and the second elastic arm are provided to align in the front-rear direction.

25. The electrical connector according to claim 23, wherein the second elastic arm is provided with an extending portion connected to the neck portion, a width of the extending portion in a left-right direction is less than a distance between the first contact portion of the second elastic arm and the second contact portion of the second elastic arm.

26. The electrical connector according to claim 18, further comprising a pushing member and two retaining members, wherein the two retaining members are respectively retained to a left side and a right side of the insulating body, each of the two retaining members is provided with an arm portion extending forward, the arm portion has an abutting portion and a buckling portion connected to the abutting portion, the buckling portion is located in front of the abutting portion, two pushing portions are respectively provided at a left side and a right side of the pushing member and extend backward, the pushing member is provided with a guiding chamfer at a rear portion of each of the pushing portions and extending backward and downward, when the pushing member moves backward relative to the insulating body, the guiding chamfer guides each of the two pushing portions to be located below the buckling portion of a corresponding one of the two retaining members and to push the abutting portion of the corresponding one of the two retaining members upward, and the two buckling portions of the two retaining members are pushed to protrude into the mating slot and to buckle with the mating member, and when the pushing member moves forward relative to the insulating body, the two pushing portions move forward to correspondingly detach from the two abutting portions of the two retaining members, and the two buckling portions of the two retaining members move downward to be released from buckling with the mating member.

27. The electrical connector according to claim 26, wherein each of the two pushing portions is provided with a first position limiting portion and a second position limiting portion, the first position limiting portion and the second position limiting portion are provided at an interval in the front-rear direction and staggered in a vertical direction, a left side and a right side of the metal shell are respectively provided with two first stopping portions and two second stopping portions located at a bottom portion of the insulating body, the first stopping portions and the second stopping portions are provided at an interval in the front-rear direction and staggered in the vertical direction, when the buckling portions of the two retaining members are buckled to the mating member, each of the first stopping portions is located in front of the first position limiting portion of a corresponding one of the two pushing portions with an interval therebetween, and each of the second stopping portions is located in front of the second position limiting portion of a corresponding one of the two pushing portions to limit the pushing member from moving forward, and when the buckling portions of the two retaining members are released from buckling with the mating member, the first stopping portions stop the first position limiting portions of the two pushing portions to limit the pushing member from excessively moving forward, and the second stopping portions are located behind the second position limiting portion of a corresponding one of the two pushing portions to limit the pushing member from moving backward.

* * * * *